US011319960B2

(12) United States Patent
Liu et al.

(10) Patent No.: US 11,319,960 B2
(45) Date of Patent: May 3, 2022

(54) PORTABLE TEMPERATURE REGULATION DEVICE

(71) Applicant: Shenzhen Lanhe Technologies Co., Ltd., Shenzhen (CN)

(72) Inventors: Kai Liu, Guangdong (CN); Weiping Li, Guangdong (CN); You Lai, Guangdong (CN); Guang Yang, Shenzhen (CN); Tong Li, Shenzhen (CN); Xunhuan Wu, Shenzhen (CN); Quan Lv, Shenzhen (CN)

(73) Assignee: SHENZHEN LANHE TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 17/507,824

(22) Filed: Oct. 22, 2021

(65) Prior Publication Data

US 2022/0065258 A1 Mar. 3, 2022

Related U.S. Application Data

(63) Continuation of application No. PCT/CN2021/116539, filed on Sep. 3, 2021.

(30) Foreign Application Priority Data

Sep. 3, 2020 (CN) ..... 202021901507.1
Sep. 18, 2020 (CN) ..... 202022072198.8
(Continued)

(51) Int. Cl.
*F04D 25/08* (2006.01)
*F04D 29/56* (2006.01)
(Continued)

(52) U.S. Cl.
CPC ..... *F04D 25/084* (2013.01); *A41D 13/0025* (2013.01); *A42B 3/286* (2013.01);
(Continued)

(58) Field of Classification Search
CPC ..... F04D 25/08; F04D 25/084; F04D 25/166; F04D 17/16; F04D 29/541; F04D 29/563;
(Continued)

(56) References Cited

U.S. PATENT DOCUMENTS 5,802,865 A * 9/1998 Strauss ..... A41D 13/0025 62/259.3
2021/0324865 A1* 10/2021 Park ..... F04D 25/166

FOREIGN PATENT DOCUMENTS

CN 207369230 U 5/2018
CN 109579200 A 4/2019
(Continued)

OTHER PUBLICATIONS

English translation of JP2019105266 (Year: 2019).*

*Primary Examiner* — Eldon T Brockman
*Assistant Examiner* — Brian O Peters
(74) *Attorney, Agent, or Firm* — Andrew C. Cheng

(57) ABSTRACT

A portable temperature regulation device includes a wearing body and first and second main bodies rotatably connected to the wearing body. The first and second main bodies each include a first housing in which a first receiving chamber is formed to receive a first fan therein. The first main body further includes a first air passage in communication with the first receiving chamber, a first air outlet communicating the first air passage and outside, an air inlet in communication with the first receiving chamber. The first and second main bodies are rotatably connected to the wearing body by a rotation structure. When it needs to fold for storage, the first and second main bodies can be rotated to a folded state,
(Continued)

so as to reduce the size of the portable temperature regulation device for easy storage by a user.

20 Claims, 24 Drawing Sheets

(30) Foreign Application Priority Data

| | | |
|---|---|---|
| Oct. 16, 2020 | (CN) | 202022316493.3 |
| Nov. 13, 2020 | (CN) | 202022640326.4 |
| Dec. 16, 2020 | (CN) | 202023042602.3 |
| Dec. 28, 2020 | (CN) | 202023232474.9 |
| Dec. 31, 2020 | (CN) | 202011641197.9 |

(51) Int. Cl.

| | |
|---|---|
| ***F04D 29/54*** | (2006.01) |
| ***F04D 25/16*** | (2006.01) |
| ***A41D 13/002*** | (2006.01) |
| ***A42B 3/28*** | (2006.01) |
| ***F04D 17/16*** | (2006.01) |
| ***A41D 23/00*** | (2006.01) |

(52) U.S. Cl.
CPC ..... *F04D 17/16* (2013.01); *F04D 25/08* (2013.01); *F04D 25/166* (2013.01); *F04D 29/541* (2013.01); *F04D 29/563* (2013.01); *A41D 2023/002* (2013.01); *F24F 2221/12* (2013.01); *F24F 2221/38* (2013.01)

(58) Field of Classification Search
CPC ..... A41D 13/0025; A41D 2023/002; A42B 3/286; F24F 2221/12; F24F 2221/38
See application file for complete search history.

(56) References Cited

FOREIGN PATENT DOCUMENTS

| | | | | |
|---|---|---|---|---|
| CN | 111120369 | A | | 5/2020 |
| CN | 211039122 | U | | 7/2020 |
| CN | 212536129 | U | | 2/2021 |
| CN | 212536145 | U | | 2/2021 |
| CN | 212690406 | U | | 3/2021 |
| CN | 213206106 | U | | 5/2021 |
| CN | 213392785 | U | | 6/2021 |
| CN | 213392786 | U | | 6/2021 |
| CN | 213392811 | U | | 6/2021 |
| JP | 2018507987 | A | | 3/2018 |
| JP | 2019105266 | | * | 6/2019 |
| KR | 1020170134443 | | * | 12/2017 |
| KR | 101936607 | B1 | | 1/2019 |

* cited by examiner

PORTABLE TEMPERATURE REGULATION DEVICE

FIELD OF THE INVENTION

The present invention relates generally to the field of household electrical appliances, and more particularly to a portable temperature regulation device.

DESCRIPTION OF THE RELATED ART

In hot summertime, electrical fans and air conditioners are the most popular temperature-lowering devices. However, such devices are generally only applicable indoors and are not carried out. When a person goes outdoors or takes rest in an open area, hand fans or natural winds are the only possible ways for cooling and lowering temperature. Often, there is situation that no wind is felt at all or waving a fan becomes exhausting. To overcome such problems, various portable fans are available in the market, but such fans are mostly designed to be held by hands, so that it is inconvenient for picking up and stowing such fans. Further, the hands may get exhausted for holding the devices for an extended period of time.

Neck-hanging fans are also available in the market. However, most of the neck-hanging fans include a fixed casing, and the entire configuration is fixed. It takes a large space for storage, and it is also inconvenient for users to carry such fans. In addition, the known neck-hanging fans often include just one single function of blowing airflows.

SUMMARY OF THE INVENTION

In view of the above problems, the present invention provides an improved portable temperature regulation device.

The disclosure provides a portable temperature regulation device, which is wearable on the neck of a human body and comprises a wearing body; and a first main body and a second main body each having an air inlet portion and an air outlet portion arranged in a length direction thereof. The first main body and the second main body are pivotably connected to opposite ends of the wearing body respectively so that the device is adjustable between a stretched state and a folded state. In the folded state, the wearing body, the first main body and the second main body are at least partly overlapped. In the stretched state, the air outlet portion is located between the air inlet portion and the wearing body.

The portable temperature regulation device provided in the disclosure provides rotatable connection between the first and second main bodies and the wearing body by means of a rotating structure. When it needs to fold for storage, the first and second main bodies can be rotated to the folded state so that at least a portion thereof is received into a storage space enclosed and delimited by an inner side of the wearing body, so as to reduce the size of the portable temperature regulation device for easy storage by a user, for example placing in a pocket for carrying.

DETAILED DESCRIPTION OF PREFERRED EMBODIMENTS OF THE INVENTION

Figure 1:
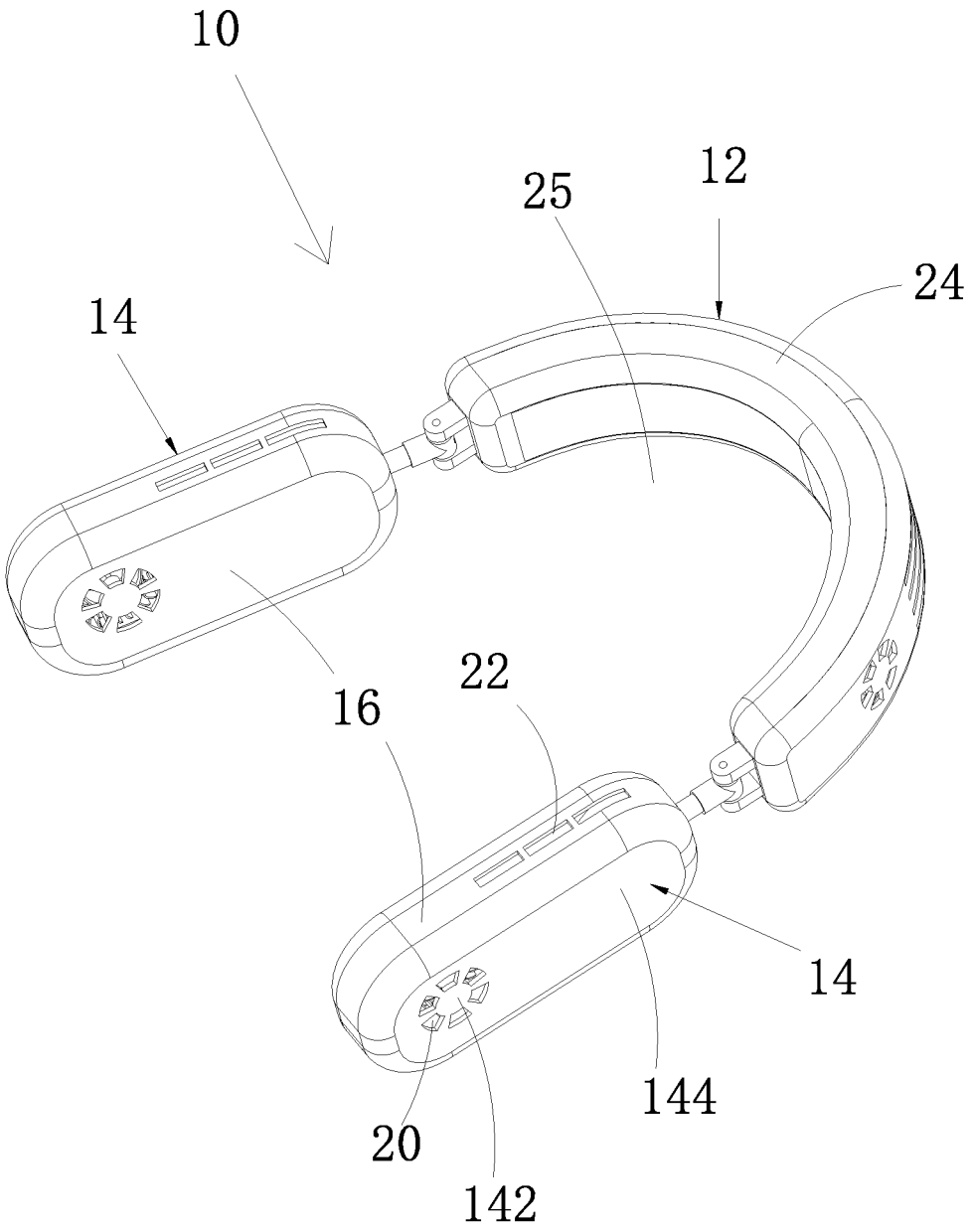
FIG. 1 is a perspective view showing a portable temperature regulation device according to a first embodiment of the present invention.
Figure 2:
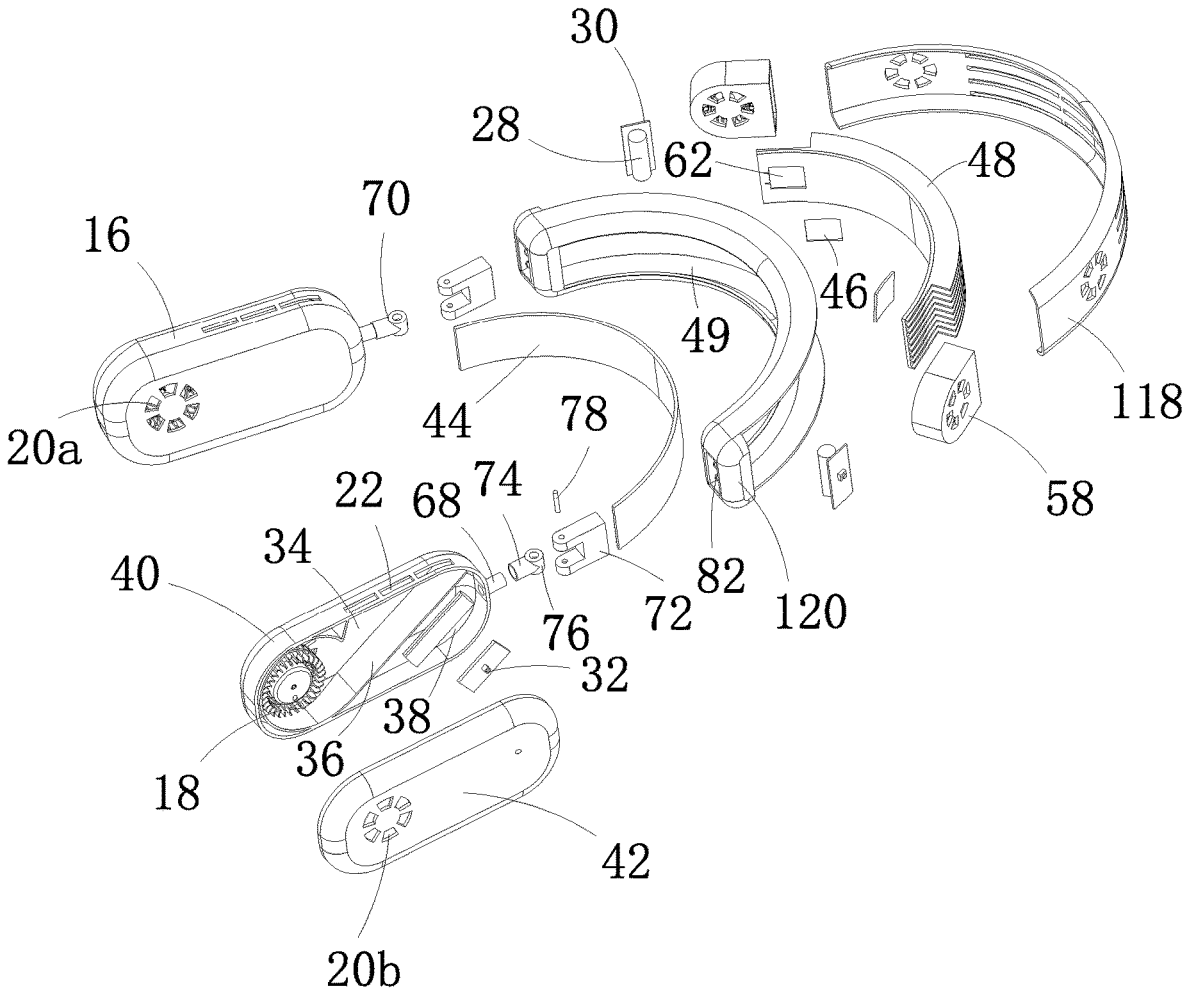
FIG. 2 is an exploded view of the portable temperature regulation device depicted in FIG. 1, taken from a predetermined angle.
Figure 3:
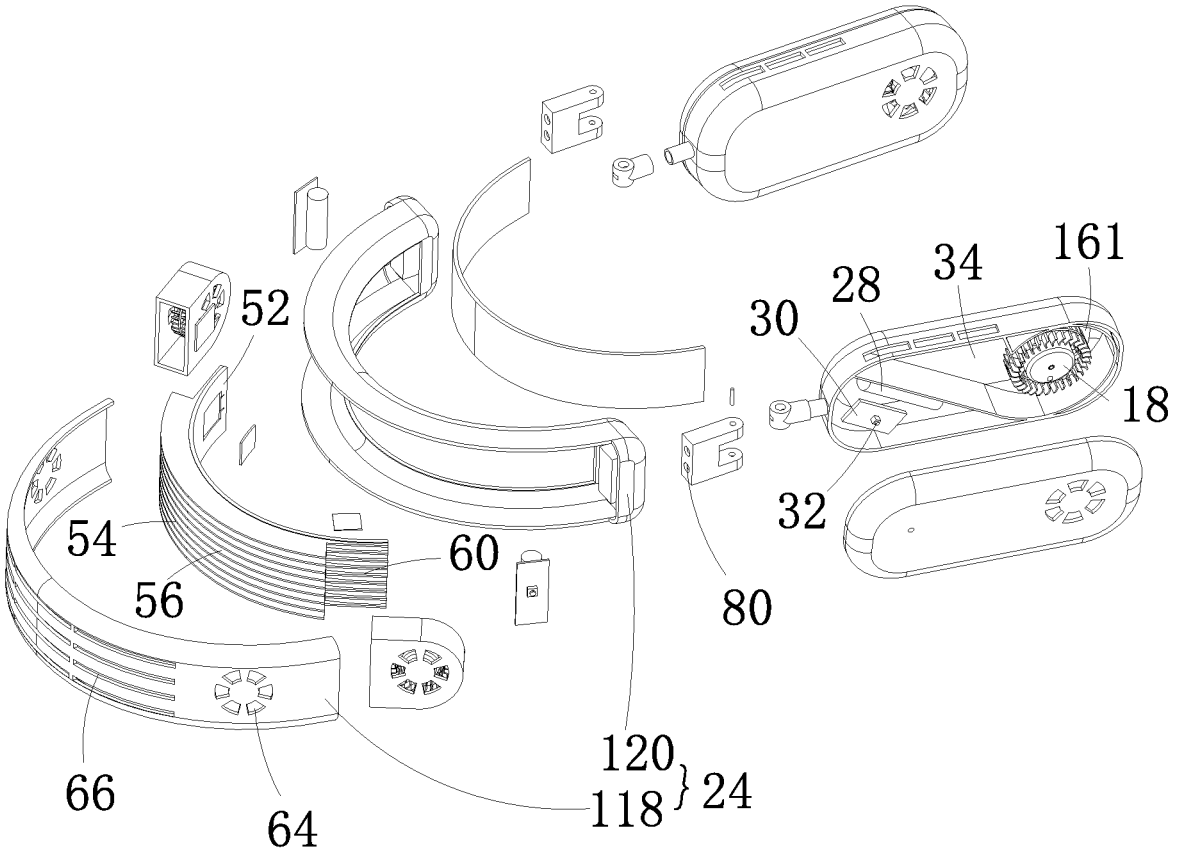
FIG. 3 is an exploded view of the portable temperature regulation device depicted in FIG. 1, taken from a different angle.

Before a detailed description is given for embodiments, it is first noted that the present invention is not limited to the detailed structure or arrangement of components provided in the following texts or the appended drawings of the application. The application may be embodied in various other ways. Further, it is noted that the languages and the terminology adopted in the disclosure are used for illustration only, and should not be construed in a constraining manner. The terms "comprise", "include", and "have", or the likes as used herein refers to including the items listed thereafter, equivalent objects, as well as items attached thereto or associated therewith. Particularly, when a description is made to "one element", it is understood that in the application, the number of such an element should not be interpreted to be just one, and may also include a multiplicity of such an element.

The present application provides a portable temperature regulation device which comprises a wearing body and two main bodies pivotably connected to opposite ends of the wearing body respectively so that the device is adjustable between a stretched state and a folded state. The two main bodies comprises a first main body and a second main body each having an air inlet portion and an air outlet portion arranged in a lengthwise direction thereof. In the folded state, the wearing body, the first main body and the second main body are at least partly overlapped. In the stretched state, the air outlet portion of the main body is located between the air inlet portion and the wearing body.

Illustrated in FIGS. 1-4 is a portable temperature regulation device 10 provided according to the first embodiment of the disclosure. The portable temperature regulation device 10 is wearable on the neck of a human body to realize effects of air blowing and temperature lowering or temperature rising. The portable temperature regulation device 10 comprises a wearing body 12 and two main bodies 14 rotatably connected to two ends of the wearing body 12. The two main bodies 14 comprise first and second main bodies 14 each of which is rotatably connected to the wearing body 12 by means of a rotating structure. The rotating structure includes a first rotation axis and a second rotation axis of which extension directions intersect, so that the two air-blowing devices 14 are rotatable, in at least two direction, relative to the wearing body 12 about the first rotation axis and the second rotation axis, respectively, to allow a user to easily adjust angles of the first and second main bodies 14 to suit the needs of temperature regulation for different angles and different body parts of the user and to ease use and folding and storage by the user. Preferably, the extension direction of the first rotation axis and the extension direction of the second rotation axis are perpendicular to each other.

In the illustrated embodiment, the first and second main bodies 14 are of the same structure and are arranged in a symmetric manner with respect to the wearing body 12. In the following, the first main body 14 and one of the rotating structures are taken as an example for illustration.

The first main body 14 comprises a first housing 16 and a first fan 18 disposed inside the first housing 16. The first housing 16 is formed with a first air inlet 20 and a first air outlet 22 corresponding to the first fan 18. The portion of the first main body 14 where the first air inlet 20 and the first fan 18 are provided forms the air inlet portion 142 of the first main body 14. Another portion of the first main body 14 where the first air outlet 22 is provided forms the air outlet portion 144 of the first main body 14. The wearing body 12 comprises a second housing 24 and a second fan 26 or a semiconductor temperature regulation assembly disposed inside the second housing 24. The semiconductor temperature regulation assembly functions to generate cold and/or heat. The second housing 24 is of a curved form, and is preferably of an arc shape that is ergonomically designed. The portable temperature regulation device comprises a battery 28, a circuit board 30, and a control switch such as an ON/OFF switch 32. The battery 28 and the ON/OFF switch 32 are each electrically connected to the circuit board 30. The battery 28, the circuit board 30, and the ON/OFF switch 32 are disposed in the first housing 16 and/or the second housing 24. The number of each of the battery 28, the circuit board 30, and the ON/OFF switch 32 can be one or each of them is arranged in multiplicity.

In the first embodiment shown in FIGS. 1-4, the first housing 16 is formed with a first receiving chamber 161 at an end of an interior thereof. The first receiving chamber 161 faces and is in communication with the air inlet 20. The first fan 18 is arranged in the first receiving chamber 161. The first housing 16 is provided, in the interior thereof, with a first air passage 34 that corresponds to the first fan 18 and is arranged along a lengthwise direction of the first housing 16. Specifically, the first housing 16 of the first main body 14 comprises an inner wall adjacent to the neck of the human body, an outer wall away from the neck of the human body and a side wall connected between the inner wall and the outer wall. The side wall comprises a top section and a bottom section opposite to the top section. The air inlet 20 comprises an inner air inlet 20*a* defined through the inner wall of the first housing 16 and an outer air inlet 20*b* defined through the outer wall of the first housing 16. The inner air inlet 20*a* and outer air inlet 20*b* are located at opposite sides of the first fan 18 and in communication with the first receiving chamber 161. That is, the air inlet portion of the first main body 14 comprises an inner surface defining the inner air inlet 20*a* and an outer surface defining the outer air inlet 20*b*. The first air outlet 22 is arranged in the top section of the side wall of the first housing 16. That is, the first air outlet 22 is defined at the top surface of the air outlet portion. In some embodiments, the first air outlet 22 comprises at least one elongated outlet hole with a length edge and a width edge shorter than the length edge, the length edge extending along a lengthwise direction of the first housing 16. More specifically, the first receiving chamber 161 (which is a cavity in which the first fan 18 is received) is arranged in the interior of the first housing 16 at an end that is distant from the wearing body 12. The first housing 16 is provided, in the interior thereof, with a first air guiding member 36, and the first air guiding member 36 is arranged along the lengthwise direction of the first housing 16 (preferably being inclined relative to the lengthwise direction) and divides the internal space of the first housing 16 into the first air passage 34 and a first accommodation compartment 38. In some embodiments, the guiding member 36 extends inclinedly from a portion of the bottom section of the side wall of the first housing 16 close to the fan 18 toward the wearing body 12 or a portion of the top section of the first housing 16 close the wearing body 12 such that a convergent air passage 34 communicating the first receiving chamber 161/air inlet 20 with the air outlet 22 is formed between the air guiding member 36 and the top section of the side wall and configured to pressurize the air flow from the air inlet 20 toward the air outlet 22. In the instant embodiment, the battery 28 is arranged in the first accommodation compartment 38 of each of the two first housings 16, and one of the first accommodation compartments 38 is further provided with the circuit board 30 and the ON/OFF switch 32. The first housing 16 is formed, in the outer wall thereof, with a through hole corresponding to the ON/OFF switch 32. The ON/OFF switch 32 includes a button extending through the through hole to expose outside the outer wall of the first housing 16 to be operated by a user for controlling activation/deactivation of the first fan 18. In other embodiments, when the battery 28 is arranged in the second housing 24, there can alternatively be such that the circuit board 30 and the ON/OFF switch 32 are arranged in the first accommodation compartment 38 of one of the first housings 16, so that the ON/OFF switch 32 may control the activation/deactivation of the air-blowing devices or the entire portable temperature regulation device. Two such first air inlets 20 are provided, and are respectively formed in an inner all and an outer wall of the first housing 16 at a location corresponding to the first fan 18 so that air can enter into the first receiving chamber 161 via the two air inlets 20. Airflow generated by the first fan 18 moves through the first air passage 34 to blow out of the first air outlets 22. In the illustrated embodiment, the first housing 16 comprises a first casing 40 and a second casing 42 that are set in mutual snapping engagement with each other to enable easy assembly or disassembly by the user.

It is noted that in the instant application, directions, such as inside and outside, up and down, front and rear, and left and right, are defined as directions when the portable temperature regulation device is put on the neck of a human body. Specifically, for the first housing 16/the second housing 24, the surface that faces toward the neck is referred to as an inner surface of the first housing 16/the second housing 24; the surface that faces away from the neck is referred to as an outer surface of the first housing 16/the second housing 24; the surface that faces toward the head is referred to as an upper surface of the first housing 16/the second housing 24; and the surface that faces away from the head is referred to as a lower surface of the first housing 16/the second housing 24. For the first housing 16, the first casing 40 is arranged to face toward the neck, and the second casing 42 is arranged to face away from the neck.

The second housing 24 is provided therein with a semiconductor temperature regulation assembly, and the semiconductor temperature regulation assembly is electrically connected to the circuit board 30. When the semiconductor temperature regulation assembly is operated for generating cold, the portable temperature regulation device 10 may generate a cold airflow for cooling purposes. Specifically, the semiconductor temperature regulation assembly comprises a heat-conducting plate 44, a semiconductor refrigeration chip 46, and a heat-dissipating member 48. The heat-conducting plate 44 is disposed on an inner surface of the second housing 24 and configured for contacting with the neck of the human body. For example, the second housing 24 is formed, in the inner wall/surface, with a retaining trough 49 in communication with an internal space of the second housing 24, and the heat-conducting plate 44 is fit and retained in the retaining trough 49. In the illustrated embodiment, the heat-conducting plate 44 exhibits a curved form adapted to the neck of a human body. The semiconductor refrigeration chip 46 and the heat-dissipating member 48 are disposed in the interior of the second housing 24. The semiconductor refrigeration chip 46 has a cold end surface in contact with the heat-conducting plate 44, and a hot end surface in contact with the heat-dissipating member 48. The heat-dissipating member 48 comprises a bottom plate 52 in contact with the hot end surface of the semiconductor refrigeration chip 46 and multiple heat-dissipating plates 54 extending from the bottom plate 52 in a direction away from the semiconductor refrigeration chip 46. The multiple heat-dissipating plates 54 are arranged to space from each other and a heat-dissipating slot 56 is formed between every two adjacent ones of the heat-dissipating plates 54.

The semiconductor temperature regulation assembly further comprises a heat dissipation fan 58, and the heat dissipation fan 58 is electrically connected to the circuit board 30 for removing heat from the heat-dissipating plates 54. In the illustrated embodiment, the heat dissipation fan 58 and the semiconductor refrigeration chip 46 are each provided by two in number to be respectively arranged at two ends of the heat-dissipating member 48. More specifically, a cut-out 60 is formed between each of two ends of the heat-dissipating plates 54 and the bottom plate 52, and two heat dissipation fans 58 are respectively set in the two cut-outs 60 in such a way that air outlets of the heat dissipation fans 58 face toward the heat-dissipating slot 56. The bottom plate 52 is formed, in an inside wall thereof at locations at two ends thereof that correspond to the cut-outs 60, with accommodation recesses 62, and the two semiconductor refrigeration chips 46 are respectively received and retained in the two accommodation recesses 62. The second housing 24 is provided with air inlet holes 64 and heat dissipation holes 66 corresponding to the heat dissipation fans 58, wherein the air inlet holes 64 are respectively formed in two ends of an outer wall of the second housing 24 at locations corresponding to air inlets of the heat dissipation fans 58, and the heat dissipation holes 66 are formed in the outside wall of the second housing 24 at locations corresponding to the heat-dissipating slots 56. The battery 28 and the circuit board 30 are provided by two in number to be respectively disposed in the interior of the second housing 24 at two ends. In the instant embodiment, the second housing 24 is also provided, in the interior thereof, with an ON/OFF switch 32 for controlling operation of the semiconductor temperature regulation assembly. Of course, in other embodiments, the semiconductor temperature regulation assembly may be electrically connected to the ON/OFF switch 32 of the first housing 16, so that the ON/OFF switch 32 in the first housing 16 may control the operation of the semiconductor temperature regulation assembly.

When the semiconductor temperature regulation assembly is operated to generate heat, the portable temperature regulation device 10 may generate a hot airflow for heating purposes. Under this condition, the semiconductor refrigeration chip 46 is switched to a heat generation mode. The air-blowing device 14 further comprises a heating element (not shown in the drawings), and the heating element can be for example an electric heating filament. The heating element is disposed in the interior of the first housing 16 for heating and converting an airflow generated by the first fan 18 into a hot airflow.

It is noted that in the instant embodiment, the semiconductor refrigeration chip 46 is operable for generating cold and may also be alternatively operable for generating heat. In some other embodiments, the semiconductor refrigeration chip 46 is arranged for operation of generating cold only or for generating heat only.

In the instant embodiment, the rotating structure comprises a first connecting member 68 connected to the first housing 16, an intermediate connecting member 70, and a second connecting member 72 connected to the second housing 24. The intermediate connecting member 70 comprises a first connecting section 74 and a second connecting section 76. The first connecting section 74 and the second connecting section 76 are integrally formed as one single body. The first connecting member 68 and the first connecting section 74 are rotatably connected and involve a first rotation axis, and the second connecting member 72 and the second connecting section 76 are rotatably connected and involve a second rotation axis. An extension direction of the first rotation axis and an extension direction of the second rotation axis are perpendicular to each other.

The second connecting member 72 has one end that is connected, for example through detachable connection, to an end of the second housing 24 and an opposite end rotatably connected to the second connecting section 76 by means of a second rotation axle 78. The second rotation axle 78 is set along an axis line that is the second rotation axis, so that the air-blowing device 14 is rotatable about the second rotation axis to move on a plane perpendicular to the second rotation axis (such as rotating leftward/rightward or inward/outward relative to the neck of the user). In the illustrated embodiment, the second connecting section 76 is formed with a first pivot hole, and the second connecting member 72 is formed, in an end facing the second connecting section 76, with a receiving trough. The receiving trough is defined by two opposite sidewalls in which second pivot holes are formed. The second connecting member 72 is rotatably received in the receiving trough. The second rotation axle 78 passes through the first pivot hole and has two ends that are respectively inserted into the two second pivot holes to thereby achieve rotating connection between the second connecting section 76 and the second connecting member 72.

The second connecting member 72 is detachably connected to the second housing 24. In the illustrated embodiment, an end of the second connecting member 72 that is connected to the second housing 24 is provided with an electrical conduction section, and the electrical conduction section includes first contact points. The first contact points are electrically connected with electronic components arranged inside the first housing 16, such as the battery 28, the circuit board 30, or the first fan 18, by means of for example conductor wires that extend through an end portion of the first housing 16, the first connecting member 68, the intermediate connecting member 70, and the second connecting member 72 to electrically connect to the first contact points. An end of the second housing 24 that is connected to the second connecting member 72 is provided with a receiving section for receiving the electrical conduction section to insert therein. The receiving section, in an interior thereof, with second contact points. The second contact points are electrically connected to electronic components arranged inside the second housing 24, such as the battery 28, the circuit board 30, or the semiconductor temperature regulation assembly. When the electrical conduction section is inserted, in a detachable manner, into the receiving section, the first contact points and the second contact points contact with each other to establish electrical connection, so that the first housing 16 may establish electrical connection with the electronic components and power source inside the second housing 24 by means of the first contact points and the second contact points. For example, in case that the battery 28 is provided only in the first housing 16, the electronic components arranged inside the second housing 24 may establish electrical connection with the battery 28 inside the first housing 16 by means of the first contact points and the second contact points to thereby supply electrical power to the electronic components arranged in the second housing 24. In the illustrated embodiment, the first contact points are embodied as electrical conduction holes 80, and the second contact points are embodied as electrical conduction poles 82. In other embodiments, the first contact points and the second contact points can be embodied as electrical conduction structures of other forms.

Figure 5:
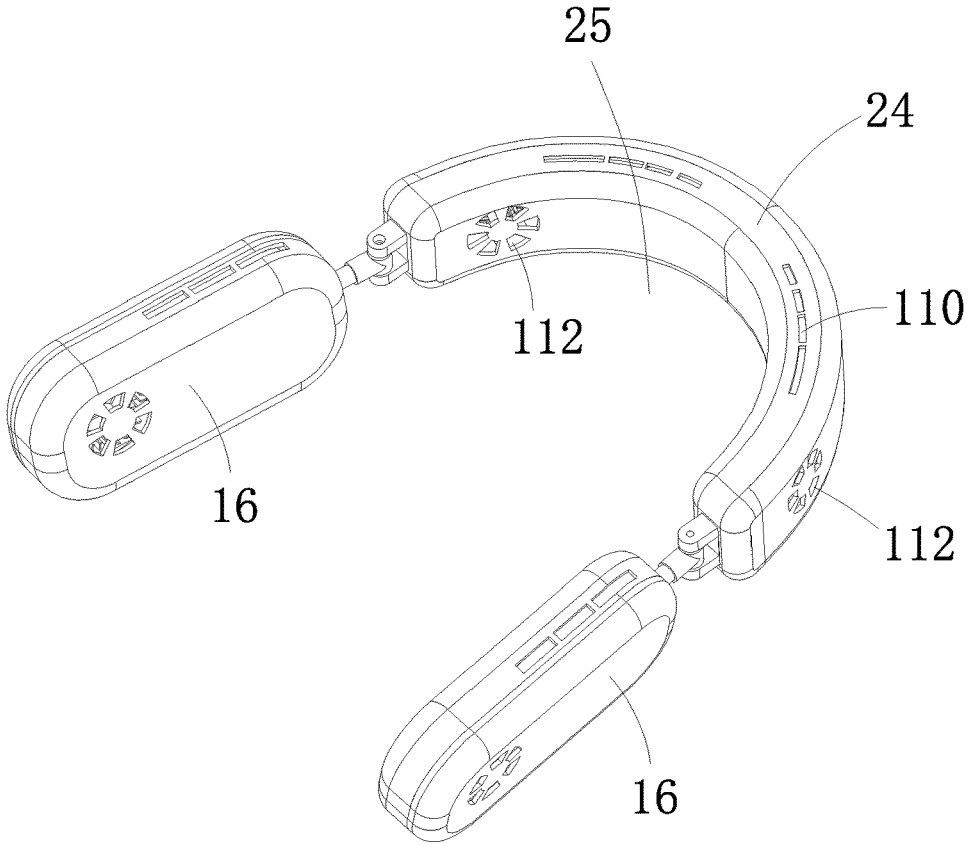
FIG. 5 is a perspective view showing a portable temperature regulation device according to a second embodiment of the present invention.
Figure 6:
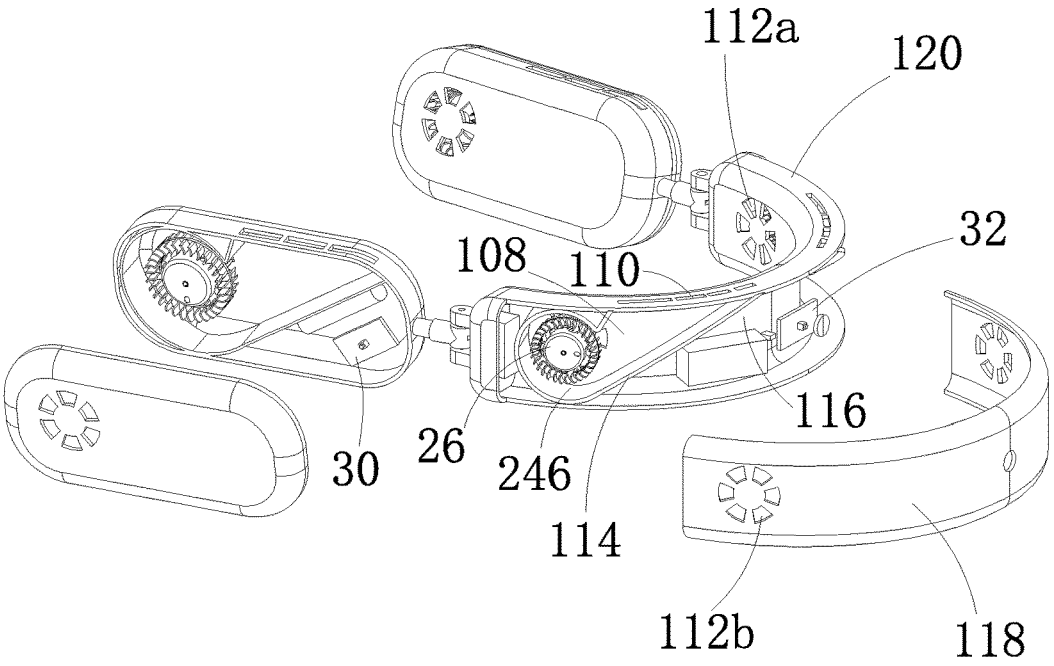
FIG. 6 is an exploded view of the portable temperature regulation device depicted in FIG. 5.
Figure 7:
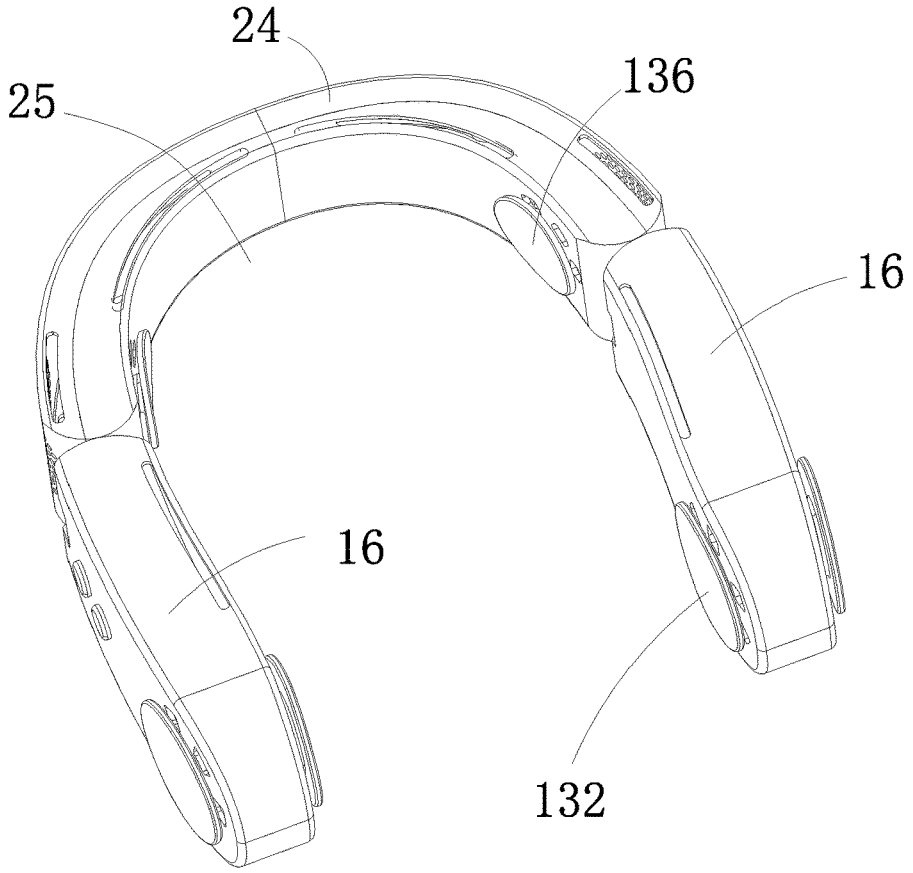
FIG. 7 is a perspective view showing a portable temperature regulation device according to a third embodiment of the present invention.

As shown in FIGS. 5-6, a portable temperature regulation device 10 according to a second embodiment of the disclosure is provided. In the embodiment, a difference from the first embodiment resides in that two ends of the interior of the second housing 24 are each provided with a second receiving chamber 246, and the two second receiving chambers 246 are each provided, in the interior thereof, with a second fan 26. The two second fans 26 are respectively disposed at the two ends of the interior of the second housing 24 and are each electrically connected to the circuit board 30. The second housing 24 is also provided, in the interior thereof, with two second air passages 108 which are respectively in communication with the second receiving chambers 246. The two second air passage 108 are arranged in a manner of being separated from each other in a lengthwise/circumferential direction of the second housing 24, so that each of the second air passages 108 corresponds to one second fan 26. The second air passages 108 are communicated with second air outlets 110 formed in a side wall of the second housing (for example a top section of the side wall of the second housing 24) adjacent to the neck of the human body. The second housing 24 comprises an inner wall, an outer wall and the side wall connected between the inner wall and the outer wall. The side wall of the second housing 24 comprises the top section and a bottom section opposite to the top section. Opposite ends of the inner and outer walls are respectively provided with second air inlets 112 in communication with the corresponding second receiving chambers 246. Airflows generated by the two second fans 26 respectively move through the second air passages 108 to blow out through the second air outlets 110.

In the illustrated embodiment, the two second air passages 108 are arranged to be separated from and independent of each other in the lengthwise/circumferential direction of the second housing 24. Since the structural arrangements of the two second fans 26, together with the second air passages 108, are identical and are symmetric with respect to a middle of the second housing 24, only one of such structural arrangement of the second fans 26 and the second air passages 108 will be described as an example for illustration. More specifically, the second housing 24 is provided, in the interior thereof, with two second air guiding members 114 each of which preferably extends from a portion of the bottom section of the side wall of the second housing 24 close to the second fan 26 toward the top section of the side wall. The second air guiding members 114 are arranged to incline relative to the lengthwise/circumferential direction of the second housing 24 to divide an internal space of the second housing 24 into the two convergent second air passages 108 and one second accommodation compartment 116 located between the two second air passages 108, wherein the battery 28, and/or the circuit board 30, and the ON/OFF switch 32 are arranged in the second accommodation compartment 116. The second housing 24 is formed, in the outer wall/surface, with a through hole corresponding to the ON/OFF switch 32, and a button of the ON/OFF switch 32 is arranged to penetrate through the through hole to expose on the outer surface of the second housing 24 for being depressible down by the user, so that the first fans 18 and the second fans 26 are independently controllable. Of course, in other embodiments, the ON/OFF switch 32 in the first housing 16 may be used to control the operation of the second fan 26; or alternatively, the first housing 16 is not provided with an ON/OFF switch 32, and the ON/OFF switch 32 of the second housing 24 is operable to control the operation of the first fan 18 in the first housing 16. The second air outlets 110 are arranged by two in number, and are respectively formed in the top section of the side wall of the second housing 24 at locations corresponding to the two second air passages 108. The second air inlets 112 corresponding to each of the second fans 26 are provided by two in number and respectively formed in the inner wall and the outer wall of the second housing 24 at locations corresponding to the second fan 26. An airflow generated by the second fan 26 moves through the second air passage 108 to blow out through the second air outlet 110. In the illustrated embodiment, the second housing 24 comprises an outer casing 118 and an inner casing 120 that are set in mutual snapping engagement with each other to enable easy dismounting and remounting by the user. The outer casing 118 forms the outer wall and the inner casing 120 forms the inner wall. In the instant embodiment, the second housing 24 is provided, in the interior thereof, with the two second air guiding members 114 that are not connected to each other and are arranged along the lengthwise/circumferential direction of the second housing 24 in order to divide the internal space of the second housing 24 into the second air passages 108 and the second accommodation compartments 116. In other embodiments, alternatively, there is only one single second air guiding member 114 arranged in the interior of the second housing 24 and arranged along the lengthwise direction of the second housing to divide the internal cavity of the second housing 24 into the second air passages 108 and the second accommodation compartment 116. In other words, the two second air guiding members 14 are connected as one single plate and the single second air guiding member 114 is provided, at a middle thereof with a separation section that separates the two second air passages 108 from each other. The battery 28 and the control switch 32 and/or the circuit board 30 are arranged in the second accommodation compartment 116. In the instant embodiment, the structure of the first housing 16 is similar to that of the first embodiment described above, and repeated description will be omitted herein.

In the illustrated embodiment, the wearing body 12 comprises an air outlet portion and air inlet portions located at opposite sides of the air outlet portion. The portions of the wearing body 12 at which the air inlets 112 and the second fan 26 are arranged form the air inlet portions. Another portion of the wearing body 12 at which the air outlet 110 are arranged forms the air outlet portion. Alternatively, the wearing body 12 comprises an air inlet portion and air outlet portions located at opposite sides of the air inlet portion. Each of the second air inlets 112 comprises an inner air inlet 112*a* passing through the inner wall of the second housing 24 and an outer air inlet 112*b* passing through the outer wall of the second housing 24. That is, the air inlet portion of the wearing body 12 comprises an inner surface defining an inner air inlet 112*a* and an outer surface defining an outer air inlet 112*b*. The air outlet portion of the wearing body 12 comprises an air outlet 110 defined at a top surface thereof.

In a third embodiment shown in FIGS. 7-10, a difference from the embodiment of FIGS. 5-6 is that the first air passage is provided, in an interior thereof, with a first air guiding member 124, and the first air guiding member 124 is of a V-shape, comprising two first plates arranged in a lengthwise direction of the first housing 16, wherein the two first plates are connected at ends that are adjacent to the first fan 18, while ends of the two first plates that are distant from the first fan 18 are connected to the side wall of the first housing, so that the first air passage is divided into two first sub air passages 126 that are tapering in a direction away from the first fan 18. The two first plates of the first air guiding member 124 respectively define the first sub air passages 126 with respect to the top section of the side wall and the bottom section of the side wall of the first housing 16. The two first sub air passages 126 are communicated with first air outlets 22 formed in the side wall of the first housing 16 adjacent to the neck of the human body. For example, two first air outlets 22 are respectively formed in inner edges of the top and bottom sections of the side wall of the first housing 16, so that air may be blown out of two opposite sides of the wearing body 14 to increase the area for discharging air. Further, the two first sub air passages 126 show a cross-sectional configuration that is tapering in a direction away from the first fan 18, so that airflow converges and becomes concentrated in the direction away from the first fan 18 to thereby ensure power of discharged air at a location of the first air outlet 22 that is distant from the first fan 18. In the illustrated embodiment, an air blocking plate 130 is arranged between the first casing 40 and the second casing 42, and the arrangement of the air blocking plate 130 helps further reduce the volume of the first sub air passages 126 to increase the airflow power discharged. Upper and lower edges of the air blocking plate 130 extending along the lengthwise direction of the first housing 16 closely contact with the inner surface of the internal space of the second housing 16 to thereby separate the first sub air passages 126 from a remaining space of the internal space of the first main body 16. Specifically, the first housing 16 comprises an inner wall, an outer wall and a side wall connected between the inner wall and the outer wall. Upper and lower edges of the air blocking plate 130 closely contact with inner surfaces of the side walls of the second housing 16. A cover plate 132 is further provided outside the first air inlet 20, and the cover plate 132 forms a gap relative to the first air inlet 20. The arrangement of the cover plate 132 helps prevent foreign objects from invading.

Figure 8:
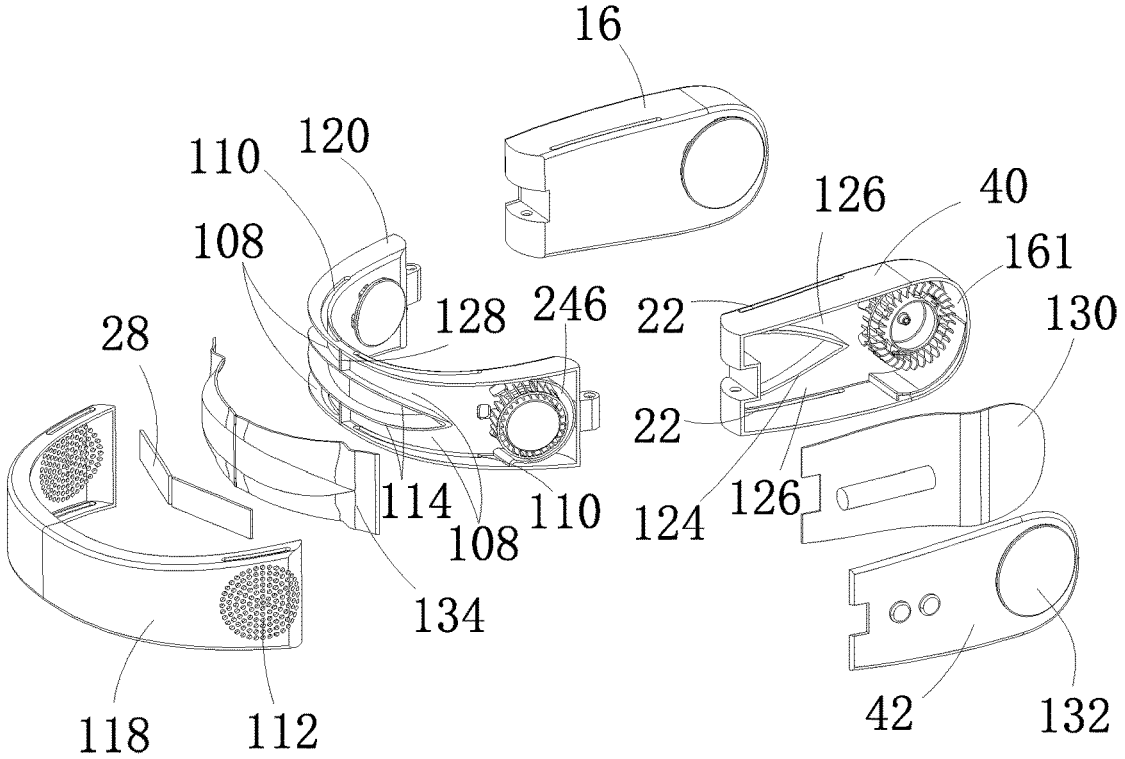
FIG. 8 is an exploded view of the portable temperature regulation device depicted in FIG. 7, taken for an example.

In the embodiment shown in FIG. 8, two second air passages 108 are arranged to separate from each other in the lengthwise direction of the second housing 24. The second housing 24 is further provided, in the interior thereof, with an air blocking plate 134 and a battery 28. The air blocking plate 134 covers the second air passages 108 to separate the second air passages 108 from a remaining space of the internal space of the second housing 24. The battery 28 is arranged at one side of the air blocking plate 134 that is opposite to the second air passages 108. In the instant embodiment, the two second air passages 108 are each provided with a second air guiding member 114. The second air guiding member 114 comprises two second plates, wherein the two second plates are connected at ends that are adjacent to the second fan 26, while ends of the two second plates that are distant from the second fan 26 are connected to a side wall of the second air passage 108, so that the second air passage 108 is divided into two second sub air passages. The two second sub air passages are communicated with second air outlets 110 formed in the side wall of the second housing 24 adjacent to the neck of the human body. Speaking in a different way, the two second air passages 108 are separated by a partition plate 128 located between the two second air passages 108, so that the two second air passages 108 are arranged to distribute in a left-right direction, meaning being arranged to distribute in the lengthwise direction of the second housing 24. The second air outlets 110 comprise first/upper air outlet holes and second/lower outlet holes provided at inner edges of the top section and the bottom section of the side wall of the second housing 24. The first/upper air outlet holes and second/lower outlet holes correspond to the second sub air passages 108 respectively, so that air may be discharged at two opposite sides of the wearing body 12 to blow toward different parts of the human body. For example, the air discharged at the top side blows toward the rear of the head of the human body, while air discharged from the bottom side blows toward the back of the human body. In some embodiments, an air guide cover may be provided on the second air outlet 110 to better conduct airflow toward the back of the human body. Supporting members 136 may be further provided on an inner wall of the second housing 24 at locations of the second air inlets 112. The supporting members 136 form, relative to the second air inlets 112, gaps to prevent the neck of the human body from blocking the second air inlets 112.

Figure 9:
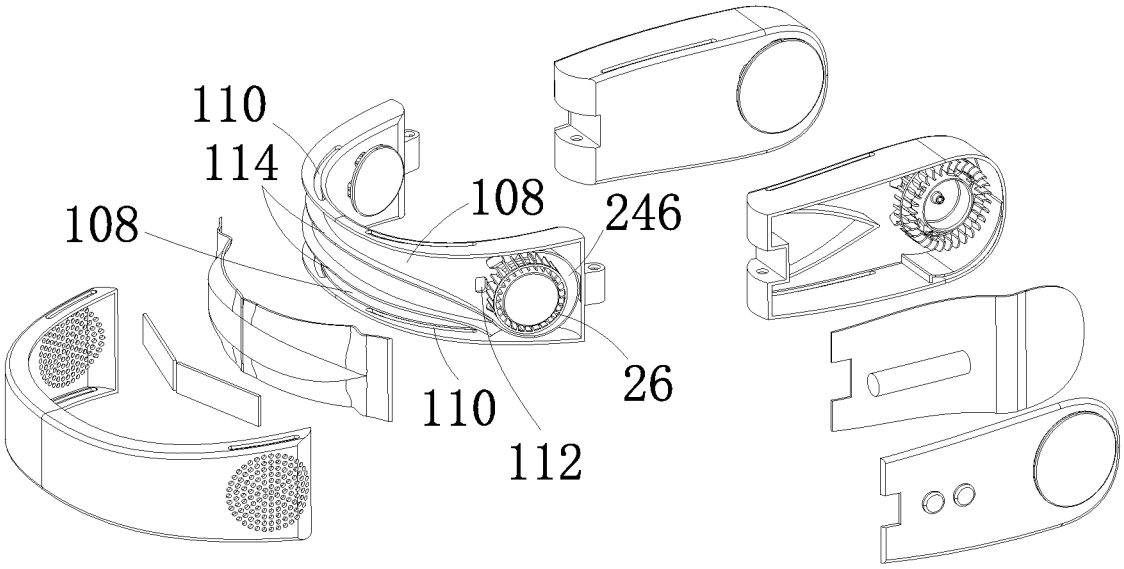
FIG. 9 is an exploded view of the portable temperature regulation device depicted in FIG. 6, taken for another example.
Figure 10:
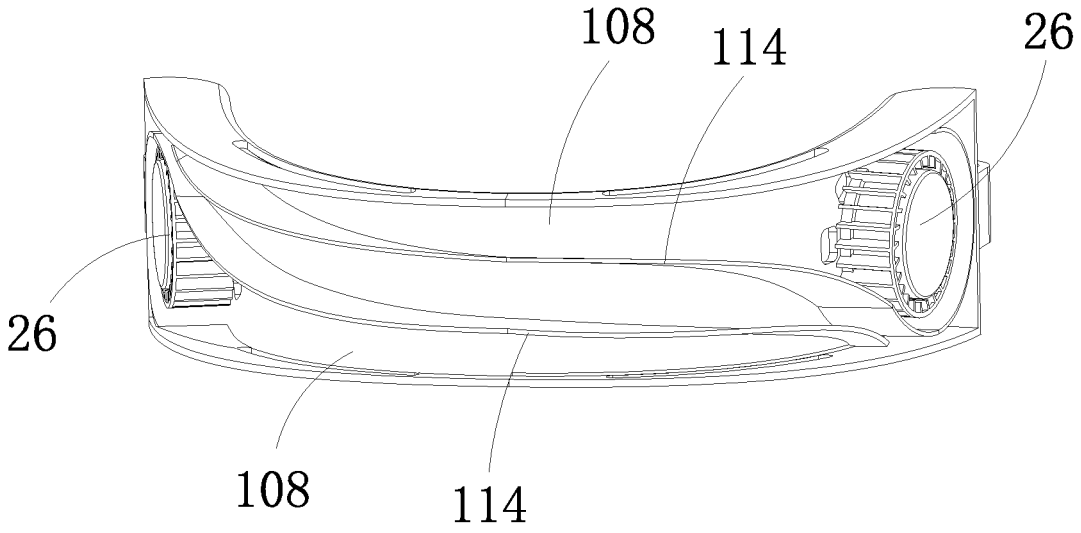
FIG. 10 is a side elevational view of an inner casing of a second main body depicted in FIG. 9.

In the embodiment shown in FIGS. 9 and 10, the two second air passages 108 are arranged to separate from each other in a height direction (perpendicular to the lengthwise/circumferential direction) of the second housing 24. The second housing 24 is provided, in the interior thereof, with second air guiding members 114 arranged in the lengthwise direction of the second housing 24. Preferably, the second air guiding members 114 are provided by two in number and the two second air guiding members 114 are each arranged in the lengthwise direction of the second housing 24. The two second air guiding members 114 are arranged to separate in the height direction of the second housing 24, and one of the second air guiding members 114 extends from the top section of the side wall of the second housing 24 adjacent to the left-side second fan 26 toward the bottom of the right-side second fan 26 and the end is curved around the second fan 26 by bending backward to form a non-closed ring configuration, while another one of the second air guiding members 114 extends from the bottom section of the side wall of the second housing 24 adjacent to the right-side second fan 26 toward the top of the left-side second fan 26 and the end is curved around the second fan 26 by bending backward to form a non-closed ring configuration. The top section of the side wall of the second housing 24 is formed with two elongate second air outlets 110 corresponding to the upper second air passage 108, and the bottom section of the side wall of the second housing 24 is formed with two elongate second air outlets 110 corresponding to the lower second air passage 108, whereby air may be discharged from two opposite sides of the wearing body 12 to blow toward different parts of the human body. The cavity formed between the two spaced second air guiding members 114 help absorb noise generated by airflow over the air guiding members 114 and increase the power of airflow exiting the second air outlets 110.

In other embodiments, there may be just one single second air guiding member 114, wherein one end of the second air guiding member 114 is connected to the top section of the side wall of the second housing 24 adjacent to one of the second fans 26, while an opposite end is extended toward the bottom of another one of the second fans 26 for curving around the second fan 26 to bend backward for forming a non-closed ring configuration, or alternatively, said opposite end is extended toward another one of the second fans 26 to connect to the bottom section of the side wall of the second housing 24, so as to separate the two second air passages 108. The two second air passages 108 are communicated with second air outlets 110 defined in top and bottom sections of the side wall of the second housing 24 adjacent to the human body to realize air discharging from two opposite sides of the second housing 24. It is appreciated that the second air guiding member 114 being arranged as a single one or two is both capable of separating the two second air passages 108 in the height direction of the second housing 24.

It is appreciated that in the embodiment shown in FIGS. 1-4, the first and second main bodies 14 can be structured similar to that shown in FIG. 6 for discharging air from two opposite sides, allowing the middle part of the portable temperature regulation device 10 to use the semiconductor refrigeration chip in the wearing body 12 to generate cold for cooling purposes, while two end parts use the first and second main bodies 14 on the two sides to blow out airflows from two opposite sides for cooling.

Specifically, the portable temperature regulation device 10 as provided in the disclosure is arranged to include the second housing 24 that is of an arc form. The second housing 24 is curved to form and surround a storage space 25 for receiving the first and/or second housings 16 therein. In some embodiments, the storage space 25 is a region surrounded by the curved second housing 24 and the straight line connecting the opposite ends of the second housing 24 (see FIG. 1 and FIG. 4). To fold the portable temperature regulation device 10, the two first housings 16 are each rotated toward the storage space 25, so that the two first housings 16 each have at least a part received in the storage space 25, or the two first housings 16 are at least partly stacked on each other and at least a part of at least one first housing 16 is received in the storage space 25 to reduce the overall size of the portable temperature regulation device 10 for easy storage. It is noted that the term "stacking" refers to the two first housings 16 being partly overlapping or entirely overlapping with the two first housings 16 being in mutual contact with each other or not in contact with each other.

Figure 11:
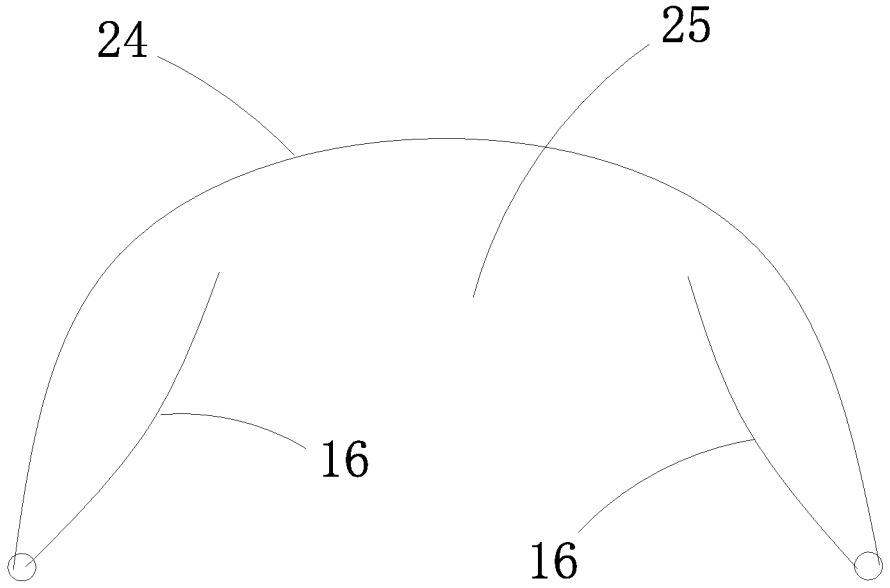
FIG. 11 is a schematic view showing a folded state of the portable temperature regulation device in one example.

FIG. 11 shows one folded form of the portable temperature regulation device 10, wherein after folding, the two first housings 16 are both located in the storage space 25, and ends of the two first housings 16 are spaced from each other by a spacing distance and are respectively at locations adjacent to the inner surface of the second housing 24.

Figure 12:
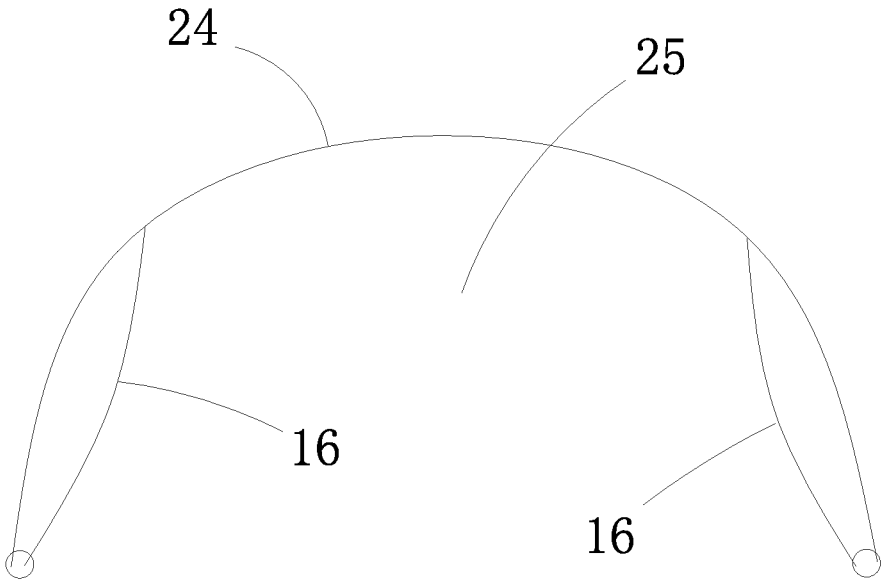
FIG. 12 is a schematic view showing a folded state of the portable temperature regulation in another example.

FIG. 12 shows another folded form of the portable temperature regulation device 10, wherein after folding, the two first housings 16 are both located in the storage space 25, and ends of the two first housings 16 are each abutting the inner surface of the second housing 24. For example, a structure that is fixable to an inner side of the second housing 24 may be provided at the ends of the two first housings 16, so that after the portable temperature regulation device 10 is folded and stored, the ends of the two first housings 16 are each connected to and thus fixed to the inner side of the second housing 24 to more securely maintain the folded form.

Figure 4:
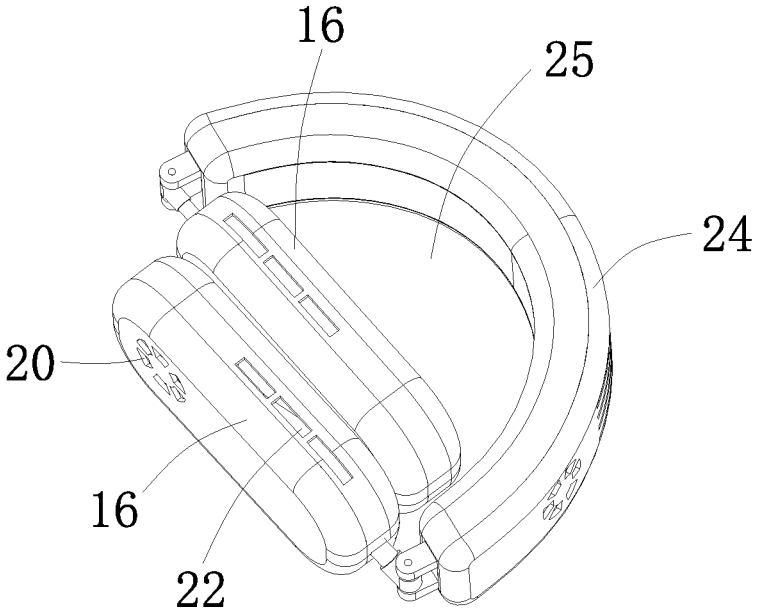
FIG. 4 is a schematic view illustrating the portable temperature regulation device of FIG. 1 in a folded state.
Figure 13:
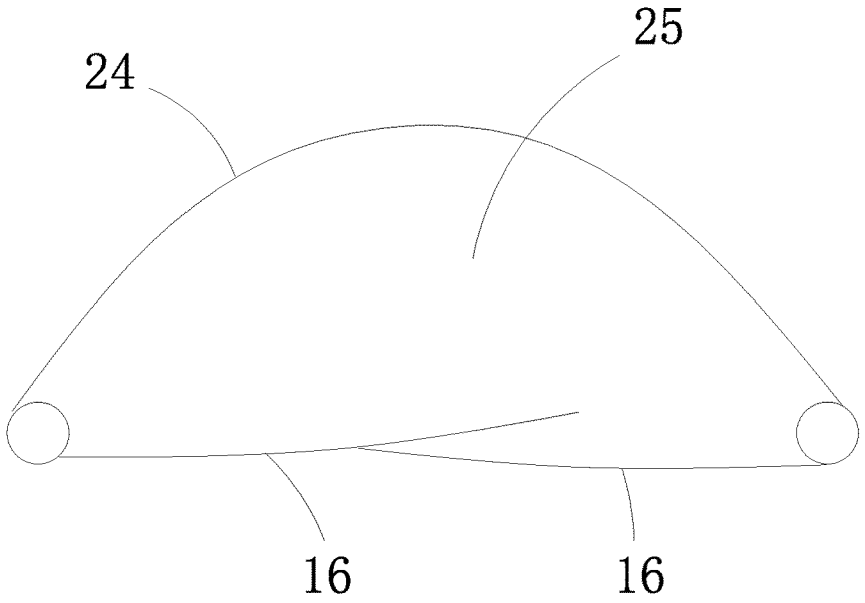
FIG. 13 is a schematic view showing a folded state of the portable temperature regulation in a further example.
Figure 14:
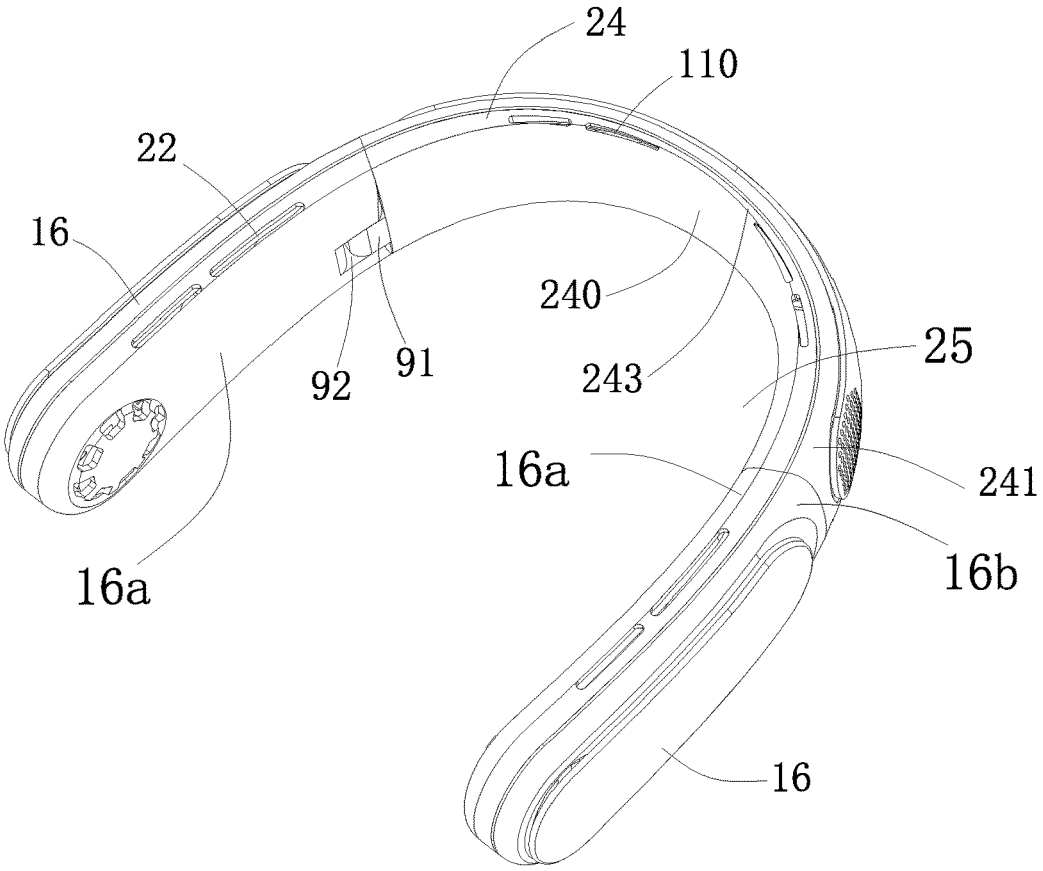
FIG. 14 is a perspective view showing a portable temperature regulation device according to a fourth embodiment of the present invention.
Figure 15:
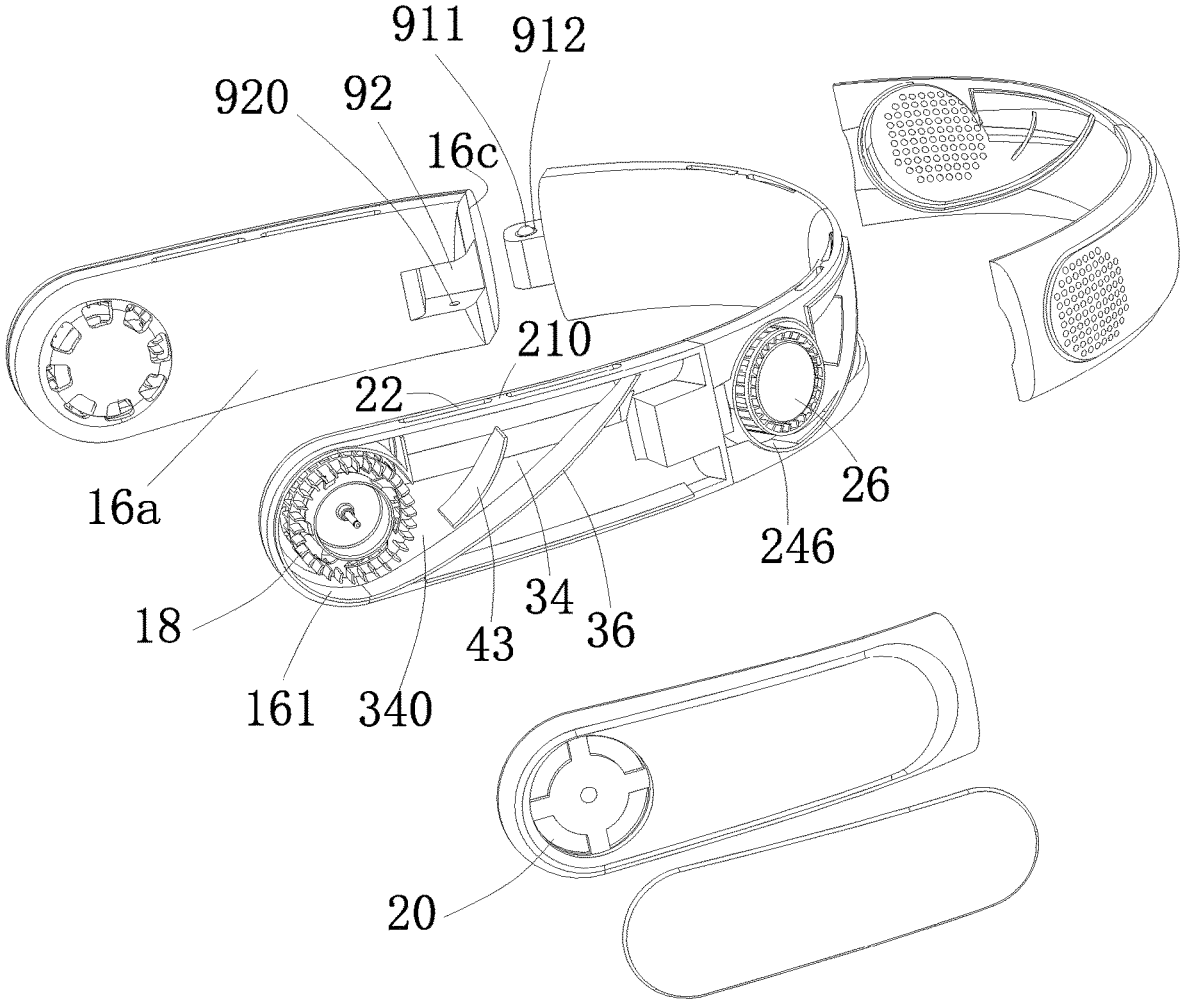
FIG. 15 is an exploded view of the portable temperature regulation device depicted in FIG. 14.
Figure 16:
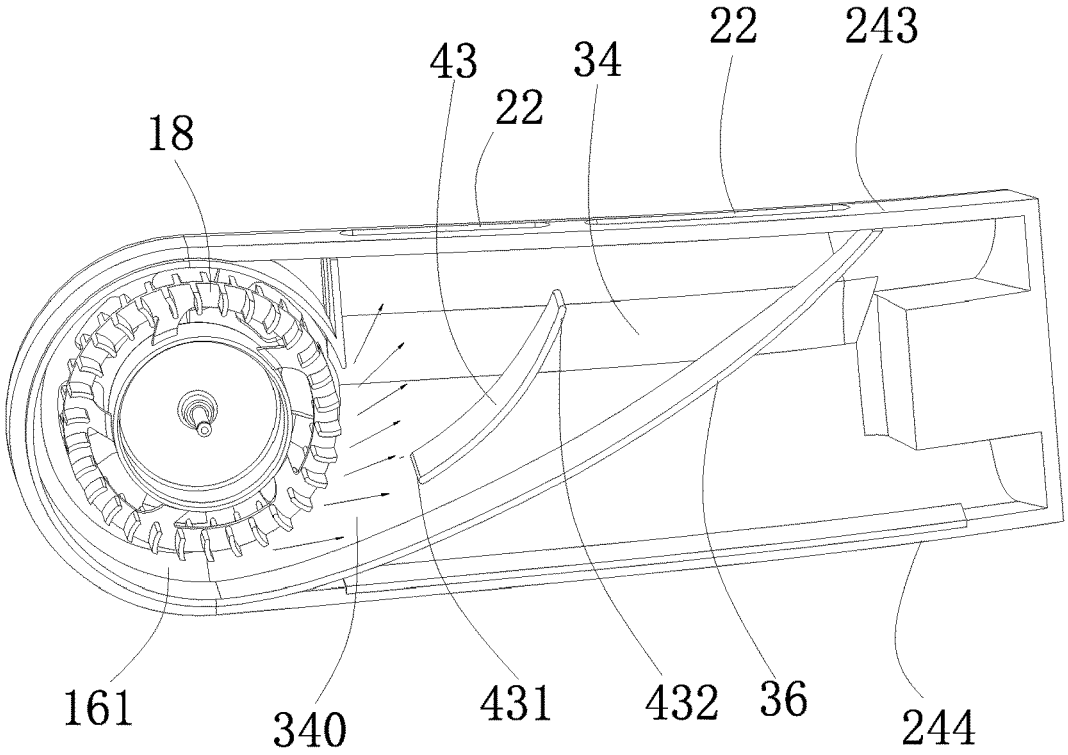
FIG. 16 is a schematic view showing inside of a first main body of the portable temperature regulation device according to the fourth embodiment.
Figure 17:
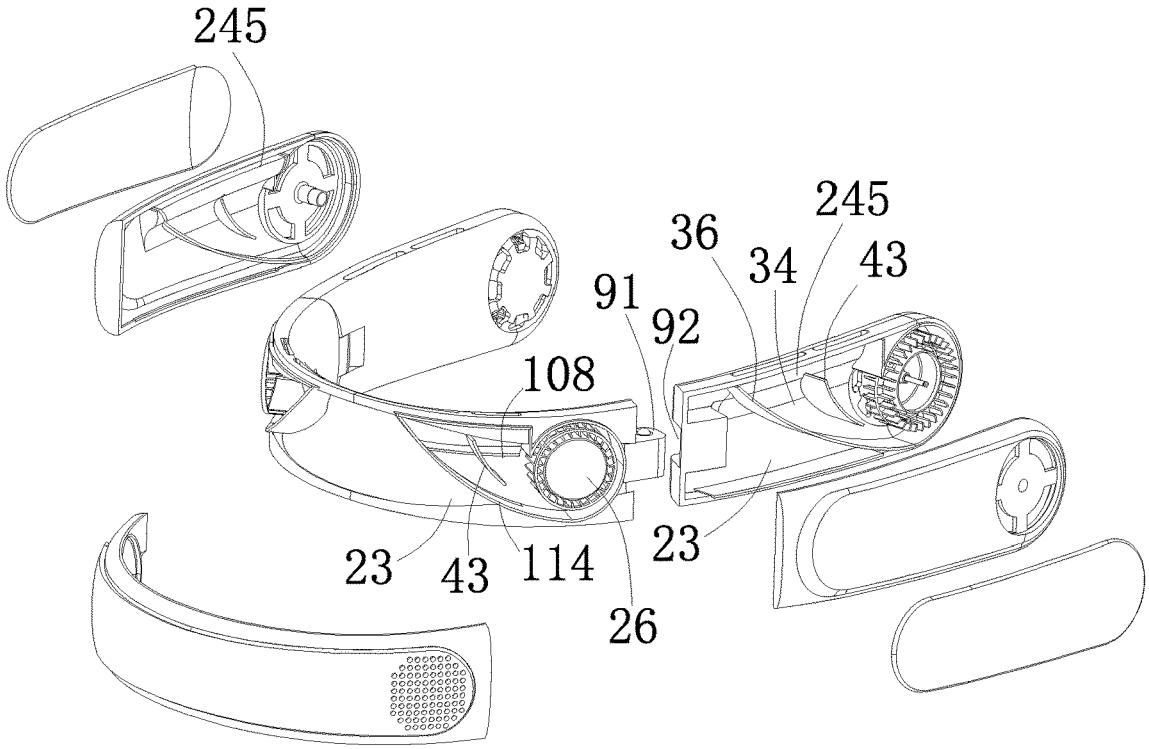
FIG. 17 is an exploded view of the portable temperature regulation device depicted in FIG. 14, taken from another angle.
Figure 23:
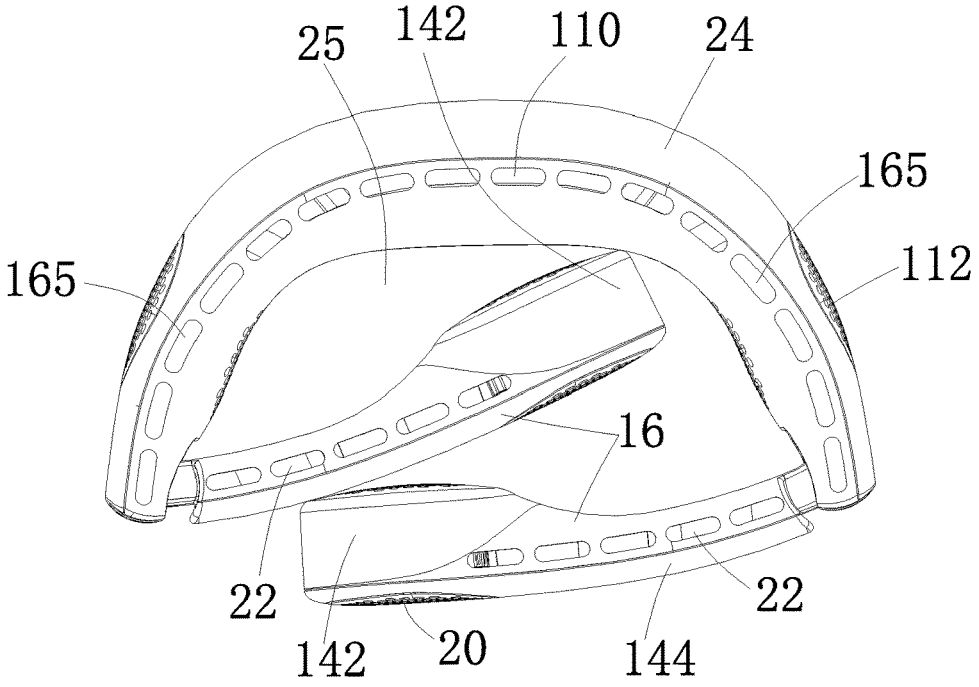
FIG. 23 is a schematic view illustrating the portable temperature regulation device of FIG. 22 in a folded state.

FIG. 13 shows a further folded form of the portable temperature regulation device 10, wherein after folding, the two first housings 16 are partly stacked on each other, an end of one of the first housings 16 contacting/abutting an outside surface of another one of the first housings 16, such that the first housing 16 that is located inward has a part received in the storage space 25, and the first housing 16 that is located outward has a part located outside the storage space 25. That is, the first main body is overlapped with the inner surface of the wearing body and the second main body is located outside of the first main body and overlapped with the first main body. In some embodiments, the first housing 16 of the first main body is located between the second housing 24 of the wearing body and the first housing 16 of the second main body, and the inner surface of the first housing 16 of the second main body 14 contacts with the outer surface of the first housing 16 of the first main body as shown in FIG. 4. In some embodiments, the air inlet portion 142 of the first main body contacts with the inner surface of the second housing 24 of the wearing body in the folded state as shown in FIG. 23. The air inlet portion 142 of the second main body contacts with the outer surface of the first housing 16 of the first main body in the folded state as shown in FIG. 23.

Referring to FIGS. 14-17, a portable temperature regulation device according to a fourth embodiment of the disclosure is provided, and in the instant embodiment, the portable temperature regulation device has a structure that is generally identical to that of the portable temperature regulation device according to the second embodiment, with a difference mainly residing in the structure of rotating connection and the structure of air passage. Specifically, in the instant embodiment, the portable temperature regulation device comprises a second housing 24 and first housings 16 rotatably connected to two ends of the second housing 24. The first housing 16 is provided, in an interior thereof, with a first fan 18, first air inlets 20 and first air outlets 22 corresponding to the first fan 18, and a first air passage 34 in communication with the first air inlets 20 and the first air outlets 22. Specifically, a first receiving chamber 161 is formed in an interior at one end of the first housing 16, and the first fan 18 is disposed in the first receiving chamber 161. The first air inlets 20 are formed in portions of the inner and outer walls of the first housing 16 facing the first receiving chamber 161, and the first air outlets 22 are formed in the side wall of the first housing 16. The first air inlets 20 pass through the portions of the inner and outer walls of the first housing 16 and are communicated with the first receiving chamber 161. The first receiving chamber 161 is provided, at one side thereof, with an airflow outlet opening 340 in communication with an inlet end of the first air passage 34. A first air distributing member 43 is further provided in an interior of the first air passage 34 to divide the first air passage 34 into multiple sub air passages. In this embodiment, the first air distributing member 43 is an air distributing plate. The first air distributing plate 43 comprises a first end 431 adjacent to the airflow outlet opening 340 and a second end 432 distant from the airflow outlet hole/opening 340. The first end 431 divides the inlet end of the first air passage 34 into a first portion and a second portion, such that an airflow discharging from the airflow outlet opening 340 is guided and distributed by the first air distributing plate 43 to flow through the first portion and the second portion into the multiple sub air passages and then flowing out through the first air outlets 22. At least a portion of the airflow that enters through the first portion is blocked by the first air distributing plate 43 so as to flow out through the first air outlets 22 between the second end 432 and the first fan 18. The airflow that enters through the second portion flows out through the first air outlets 22 located at a side of the second end 432 away from the first fan 18.

In the instant embodiment, the first fan 18 is a centrifugal fan which discharges air in a non-uniform manner in a height direction of the airflow outlet opening 340. By means of the arrangement of the first air distributing plate 43 inside the first air passage 34, the inlet end of the first air passage 34 is divided by the first end 431 of the first air guide plate 43 into the first portion and the second portion. The air discharged through the airflow outlet opening 340 of the centrifugal fan 18 is guided and conducted by the first air distributing plate 43 to move through the first portion and the second portion to enter the first air passage 34 so as to flow out through the first air outlet 22. At least a portion of the air that enters by moving through the first portion is blocked by the first air distributing plate 43 to flow out through portions of the first air outlet 22 between the second end 432 and the first fan 18, in order to prevent the air discharged through the airflow outlet opening 340 of the centrifugal fan from concentratively flowing, due to centrifugal forces and inertia, toward portions of the first air outlet 22 located between the second end 432 and the distal end of the air guiding member 36 that is distant from the first fan 18. By means of the arrangement of the first air distributing plate 43, the airflow generated by the centrifugal fan and discharging from the airflow outlet opening 340 can be guided and distributed, in a more uniform manner, toward the first air outlet 22 corresponding thereto, so as to make the flow of air discharging from the first air outlets 22 at different locations on the first housing 16 more uniform to thereby enhance experience of the user for heat dissipation.

The first air outlet 22 comprises multiple air outlet holes distributed on the first housings 16 in the lengthwise direction. A separation section 210 is formed between every two adjacent air outlet holes. The second end 432 is pointed toward the air discharging surface of the first air passage 34, and is preferably pointed toward the separation section 210 on the air discharging surface. Areas of the air outlet holes on the two sides of the separation section 210 are generally equal. The air flowing from the airflow outlet opening 340 of the first fan 18 into the interior of the first air passage 34 is subjected to separation by the first end 431 of the first air distributing plate 43 to move, through two sides of the first end 431, into the first portion and the second portion of the inlet end of the first air passage 34. The first end 431 of the first air distributing plate 43 divides the air into two fractions that respectively move through the first portion and the second portion to enter the first air passage 34 to subsequently flow out through air outlet holes that are located on two opposite sides of the second end 432 of the first air distributing plate 43. As such, the first air distributing plate 43 helps to guide and distribute the air blown out of the airflow outlet opening 340 of the fan toward the air outlet holes in a uniform manner, making the air flowing out of the air outlet holes uniformly. Optionally, the first air distributing plate 43 is in a form of a curved plate, and the direction of curving of the first air distributing plate 43 corresponds to a rotating direction of blades of the fan; or, alternatively, the first air distributing plate 43 is in the form of a straight flat plate, and the direction of extension of the length of the first air distributing plate 43 intersects a flowing direction of the airflow. The first air distributing plate 43 can be either a curved plate or a straight flat plate, in which the direction of curving is corresponding to the rotating direction of the fan blades or the extension direction intersects the flowing direction of the airflow, in order to guide at least a portion of the air entering through the first portion to flow toward the air outlet holes located between the second end 432 and the fan, and a portion of the air flow is changed in the flowing direction to make air discharging out of the air outlets on the two opposite sides of the second end 432 more uniform.

Specifically, in the instant embodiment, a first sidewall and a second sidewall are respectively arranged at two opposite sides of the first air passage 34. The top section of the side wall of the first housing 16 forms the first sidewall of the first air passage 34. The first air guiding member 36 forms the second sidewall of the first air passage 34. The first air outlets 22 are formed in the first sidewall. The second end 432 of the first air distributing plate 43 is oriented toward the first sidewall, and the first end 431 is oriented toward the second sidewall. The first end 431 and the first sidewall define therebetween the first portion of the inlet end of the first air passage 34, and the first end 431 and the second sidewall define therebetween the second portion of the inlet end of the first air passage 34. The second end 432 is spaced from the first sidewall of the first air passage 34 by a predetermine distance in order to make a portion of the air entering through the first portion but not flowing out through the first air outlet 22 located between the second end 432 and the first fan 18 flow toward the back side of the first air distributing plate 43 for flowing out of the first air outlet 22 located between the second end 432 and the end of the first sidewall that is distant from the first fan 18. Of course, in other embodiments, the second end 432 can be abutting and connected to the first sidewall of the first air passage 34, such as being connected to the separation section 210, in order to guide the air that enters through the first portion toward and flowing out of the first air outlet 22 between the second end 432 and the second fan 26.

The inner surface of the downstream of the first air passage 34 that is close to the first air outlet 22 is formed with an air compression protrusion 245 protruding toward the interior of the first air passage 34, such that a portion of the cross-section of the first air passage 34 that is adjacent to the first air outlets 22 has a dimension that is smaller than that of a remaining portion and consequently, air that flows along the first air passage 34, when discharging from the first air outlets 22, is subjected to compression by the air compression protrusion 245 that is located adjacent to the first air outlets 22 so as to flow out of the first air outlets 22 with an increased speed and the wind power is increased to be effectively and fast supplied to the neck of the user for cooling. Understandably, an air compression protrusion 245 may be provided within the second air passage 108.

Specifically, in the instant embodiment, the second air passage 108 of the second housing 24 is similarly provided with a first air distributing plate 43, and the second fan 26 is also a centrifugal fan, wherein an airflow generated by the rotation of the second fan 26 moves through the second air passage 108 to be subsequently blow out of second air outlets 110. Of course, in other embodiments, the first fan 18 and the second fan 26 can alternatively be a mixed-flow fan or fans of other types. The disclosure provides the arrangement of the first air distributing plate 43 that allows the airflow generated by the fan 18/26 to be uniformly guided toward and flowing out of the air outlets 22/110, making air discharging through air outlets 22/110 at different locations in a more uniform manner.

A structure that enables rotating and folding between the first housing 16 and the second housing 24 will be described in a more detailed way in the following.

Optionally, the first housing 16 is provided with a pivoting section 91, and the second housing 24 is provided with a recessed notch 92 matching and mating the pivoting section 91. The pivoting section 91 is formed with a first rotation portion, and the second housing 24 includes a second rotation portion formed on a surface inside the recessed notch 92. The second housing 24 and the first housing 16 are foldably or collapsibly connected by means of the pivoting section 91 received in the recessed notch 92 and the first rotation portion and the second rotation portion mating and engaging with each other. The first rotation portion can comprise a recess 912 formed in a side surface of the pivoting section 91 and a positioning bead 911 partly received in the recess 912; and the second rotation portion can comprise a positioning recess 920 formed in a surface that surrounds and defines the recessed notch 92 and mates with the positioning bead 911. The second housing 24 and the first housing 16 are connected to each other by means of the pivoting section 91 received in the corresponding recessed notch 92 and a part of the positioning bead 911 that projects outside the recess 912 fit and retained in the positioning recess 920. In the above embodiment, the first housing 16 and the second housing 24 are connected to each other by means of the arrangement of the pivoting section 91 and the recessed notch 92 and the positioning bead 911 fit and retained in the corresponding positioning recess 920 when the pivoting section 91 is received in the recessed notch 92, wherein the positioning bead 911 and the corresponding positioning recess 920 form spherical surface mating engagement, enabling fast connection and disconnection between the first housing 16 and the second housing 24 and also enabling rotation and folding of the first housing 16 and the second housing 24 by using the site where the positioning bead 911 is located as a hinging point. Through detaching and folding relative to each other between the first housing 16 and the second housing 24, storage of the portable temperature regulation device is made easy. Thus, the positioning bead 911 described above can be regarded as a rotation axle.

The first housing 16 of the first main body comprises a connecting end connected to the second housing 24 of the wearing body. The connecting end is provided with a recessed notch 92 which is formed by recessing from an inner surface 16*a* and an end surface 16*c* of the first housing 16, but does not extend through the outer surface 16*b*. That is, the recessed notch 92 passes through the inner surface 16*a* and the end surface 16*c* of the connecting end and is covered by the outer surface 16*b* of the connecting end. When the first main body and the wearing body are connected together and the first main body is located at an unfolded/stretched state (as shown in FIG. 13), the pivoting section 91 is received in the corresponding recessed notch 92 and the outside surface 16*b* of the first housing 16 of the first main body is set flush with an outside surface 241 of the second housing 24 of the wearing body. The recessed notch 92 is recessed from the inner surface 16*a* of the first housing 16 toward the outer surface 16*b* by a depth that is smaller than a thickness of the first housing 16. When the first housing 16 and the second housing 24 are connected, the outside surface 16*b* of the first housing 16 and the outside surface 241 of the second housing 24 are kept flush with each other, so as to keep the outer surface 16*b*/241 of the portable temperature regulation device smooth and flat to enhance aesthetics, and also to limit the rotation direction of the first housing 16 relative to the second housing 24 to ensure the stability of use of the first housing 16 and the second housing 24 after conversion from a folded state to an stretched state. In the stretched state, the first main body is rotatable relative to the wearing body unidirectionally. That is, in the stretched state, the first main body is only rotatable relative to the wearing body inwardly to the folded state.

Optionally, the recess 912 and the positioning bead 911 are provided in each of two opposite sides of the pivoting section 91. An extension line of a connecting line between the positioning beads 911 intersects the top surface 243 and the bottom surface 244. The positioning beads 911 are respectively set at the two opposite surfaces of the pivoting section 91 that are parallel with the top surface 243 and the bottom surface 244, so that the first housing 16 and the second housing 24 are allowed to rotate relative to each other about a pivot point defined by the positioning beads 911 and limiting the rotating direction of the first housing 16 relative to the second housing 24 to only include a direction toward the inner surface 240 of the second housing 24 and a direction away from the inside surface 240 of the second housing 24 thereby allowing the first housing 16 to rotate relative to the second housing 24 in the direction toward the inside surface 240 of the second housing 24 for folding and thus forming the folded state, and allowing the first housing 16 to rotate relative to the second housing 24 from the folded state in the direction of away from the inside surface 240 to the stretched state in which the outside surfaces 241 of the first housing 16 and the second housing 24 are flush with each other.

In some embodiments, an elastic piece is arranged between the positioning bead 911 and the surface that surrounds and forms the recess 912. In a natural condition, the elastic piece generates a resistive pushing force on the positioning bead 911, such that a part of the positioning bead 911 is forcibly projecting out of the recess 912. Two ends of the elastic piece are respectively connected to the positioning bead 911 and the surface that surrounds and forms the recess 912. By means of the arrangement of the elastic piece, in case that the positioning bead 911 is not acted upon by an external force for being pressed down, the positioning bead 911 is acted upon by the elastic piece to partly project outside the recess 912. When the first housing 16 and the second housing 24 are being connected to each other, during the process of inserting the pivoting section 91 into the recessed notch 92, the part of the positioning bead 911 that projects outside the recess 912 is compressed by the surface that surrounds and forms the recessed notch 92, so that the elastic piece is compressed and the positioning bead 911 is retracting back and received into the recess 912. When the pivoting section 91 is moving inside the recessed notch 92 to reach the position where the positioning bead 911 is in alignment with the positioning recess 920, the positioning bead 911 is no longer compressed by the surface that surrounds and forms the recessed notch 92 and the elastic piece restores from the compressed state to push the positioning bead 911 to project outside the recess 912 again. Under such a condition, the positioning bead 911 that projects outside the recess 912 is received in the positioning recess 920, achieving an effect of connecting the first housing 16 and the second housing 24. Oppositely, to detach the first housing 16 and the second housing 24 from each other, it only needs to hold the first housing 16 and the second housing 24 to apply a force in a direction of being mutually away from each other, so that the positioning bead 911 slides out of the positioning recess 920. After the positioning bead 911 slides out of the positioning recess 920, the positioning bead 911 is once again compressed by the surface that surrounds and forms the recessed notch 92 to thereby compress the elastic piece, making the elastic piece compressed and the positioning bead 911 received into the recess 912 until the pivoting section 91 separates from the recessed notch 92, and the elastic piece restores once again from the compressed state to resume a state before the second housing 24 and the first housing 16 are not connected. Optionally, the elastic piece comprises a spring.

Figure 18:
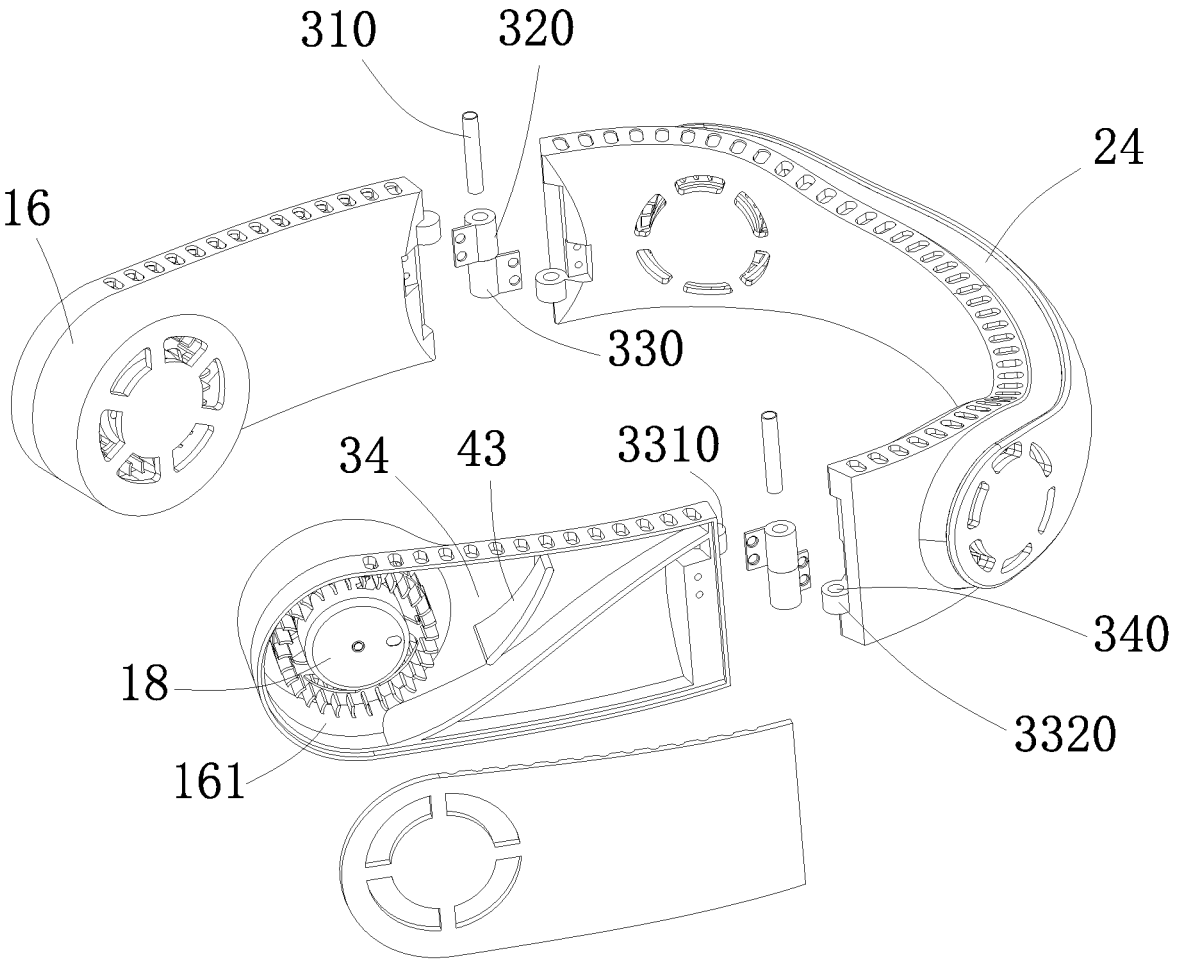
FIG. 18 is an exploded view showing a portable temperature regulation device according to a fifth embodiment of the present invention.

Referring to FIG. 18, a schematic view is provided to depict a portable temperature regulation device according to a fifth embodiment of the present invention. In the instant embodiment, the structure of the portable temperature regulation device is generally identical to that of the fourth embodiment described above and a difference resides in the structure of rotating connection. The rotating structure comprises a rotation axle 310 and connecting members that are fit outside the rotation axle 310. The connecting members comprise a first connecting member 320 and a second connecting member 330. The first connecting member 320 is mounted to and connected with the first housing 16, and the second connecting member 330 is mounted to and connected with the second housing 24. The first connecting member 320 and the second connecting member 330 are each rotatable about the rotation axle 310, so as to achieve the rotatable connection between the first housing 16 and the second housing 24.

In the instant embodiment, the rotating structure of the portable temperature regulation device is made independent of the first housing 16 and the second housing 24, so as to allow the rotating structure to be manufactured by selecting a material having an enhanced structural strength. For example, inner and/or outer casings of the first housing 16 and the second housing 24 are made of plastics, while the rotating structure is made of a metallic material in order to prevent the rotating portion of the portable temperature regulation device from being readily broken and ruptured, and also allowing easy replacement of the rotating structure. The rotating structure is mounted to and connected with the first housing 16 and the second housing 24 by means of the first connecting member 320 and the second connecting member 330, and assembling is made easy and structure of the connecting portion of the first housing 16 and the second housing 24 can be simplified to ease the structural design of the first housing 16 and the second housing 24 and reduce the manufacturing cost.

Specifically, the rotating structure further comprises a first abutting portion 3310 and a second abutting portion 3320 respectively located at two ends of the rotation axle 310. The first abutting portion 3310 is formed on the first housing 16, and the second abutting portion 3320 is formed on the second housing 24. After the rotation axle 310 is set penetrating through the first connecting member 320 and the second connecting member 330, the first connecting member 320 and the second connecting member 330 are respectively connected to the first housing 16 and the second housing 24 corresponding thereto, and the two ends of the rotation axle 310 are respectively in abutting engagement with the first abutting portion 3310 of the first housing 16 and the second abutting portion 3320 of the second housing 24 to achieve the rotatable connection between the first housing 16 and the second housing 24 by means of the rotating structure. The first abutting portion 3310 and the second abutting portion 3320 allow the rotation axle 310 to rotate relative thereto and cooperatively hold the rotation axle 310 in the axis direction of the rotation axle 310. Optionally, the rotation axle 310 is of a hollow structure, the first abutting portion 3310 and the second abutting portion 3320 are each formed with a wire extension hole 340, so that a conductor wire may extend through the wire extension hole 340 of the first abutting portion 3310, the rotation axle 310, and the wire extension hole 34 of the second abutting portion 3320 to connect to the electronic components arranged inside the first housing 16 and the second housing 24 to thereby allow the conductor wire to be completely enclosed in the rotating structure for effective protection of the conductor wire.

Preferably, a soft protective enclosure may be provided. The soft protective enclosure is sleeved around the rotating structure with opposite ends of the soft protective sleeve being connected with the first housing 16 and the second housing 24 respectively, thereby enclosing the rotating structure and connecting the first housing 16 and the second housing 24 smoothingly to prevent hair of the user from being drawn into inside of the rotating structure and thus increase user safety.

Figure 19:
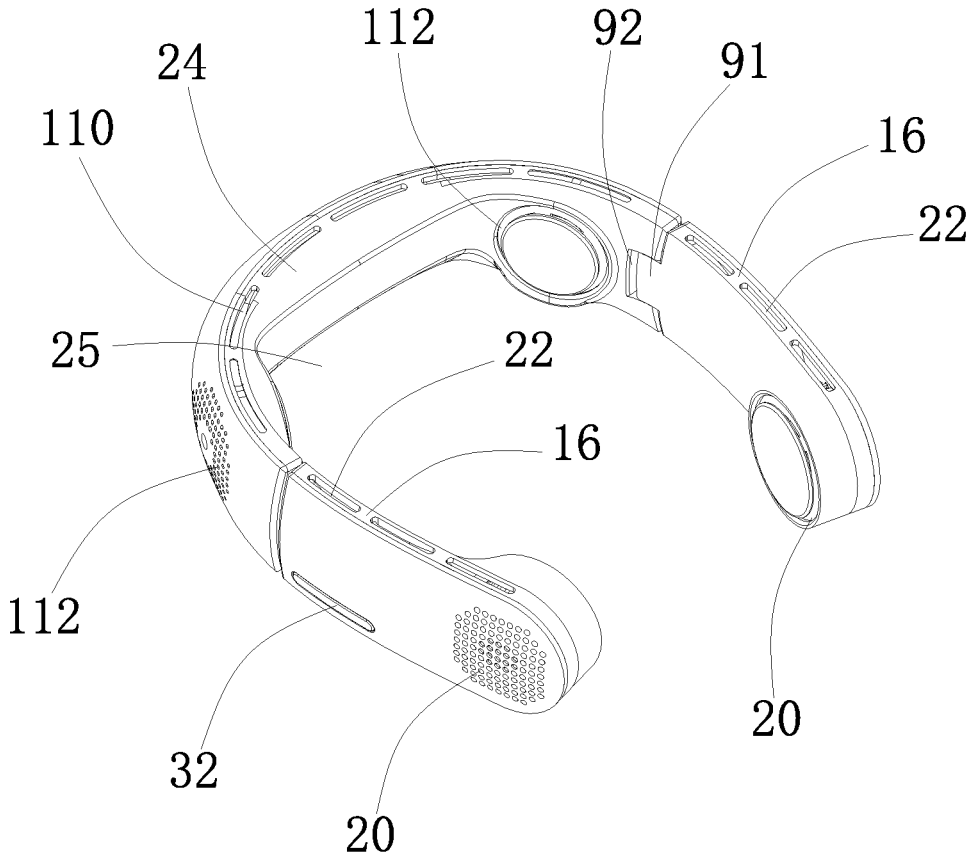
FIG. 19 is an exploded view showing a portable temperature regulation device according to a sixth embodiment of the present invention.
Figure 20:
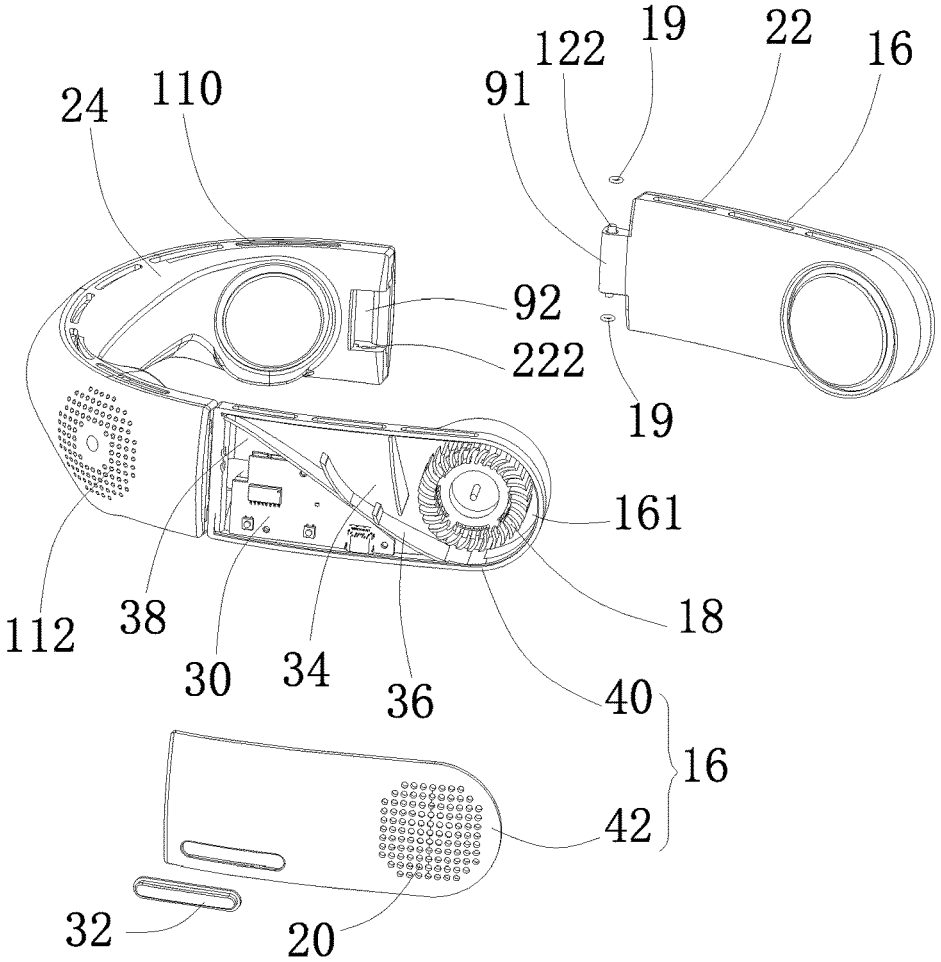
FIG. 20 is an exploded view of the portable temperature regulation device depicted in FIG. 19.
Figure 21:
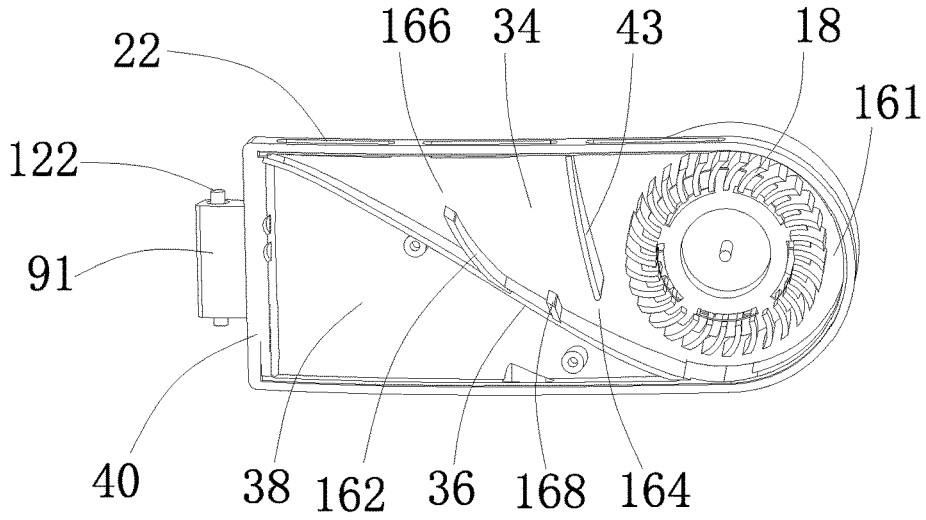
FIG. 21 is a schematic view showing a first casing of the portable temperature regulation device depicted in FIG. 20.

Referring to FIGS. 19-21, which are schematic views showing a portable temperature regulation device according to a sixth embodiment of the present invention, the instant embodiment is generally the same as the second and fourth embodiments described above and a major difference resides in the structure of rotating connection and the structure of the air passage. Specifically, in the instant embodiment, the portable temperature regulation device comprises two first housings 16 that are arranged symmetric and a second housing 24 connected between the two first housings 16. The second housing 24 is of a curved form, surrounding and defining a storage space 25 for receiving the first housings 16 therein. The two first housings 16 are each rotated toward the storage space 25, so as to have the two first housings 16 each received, at least partly, in the storage space 25, or to have the two first housings 16 at least partly stacked on each other, and at least a part of at least one first housing 16 received in the storage space 25. Each first housing 16 comprises a first connecting end and a free end opposite to each other, wherein the first connecting end is connected to the second housing 24, and the free end is distant from the second housing 24. Two ends of the second housing 24 are each formed as a second connecting end, and each of the second connecting ends is rotatably connected to the first connecting end of one of the first housings 16. One of the first connecting end and the second connecting end corresponding thereto is protruded to form a pivoting section, and the other one is recessed to form a recessed notch. The pivoting section is rotatably inserted into the recessed notch to rotatably connect the first housing 16 and the second housing 24 to each other, in order to adjust a relative angle, or speaking in a different way a relative position, between the first housing 16 and the second housing 24, and thus changing a state of use of the portable temperature regulation device.

As shown in FIG. 20, in the instant embodiment, the first connecting end of the first housing 16 is formed with the pivoting section 91, and the second connecting end of the second housing 24 is formed with the recessed notch 92. It is noted that in some embodiments, the pivoting section 91 can be formed on the second connecting end, and correspondingly, the recessed notch 92 is formed in the first connecting end, both being similarly connected in a rotatable manner through insertion so as to have the first housing 16 and the second housing 24 rotatable relative to each other. Preferably, a damping piece 19 is arranged between the pivoting section 91 and the recessed notch 92, and the damping piece 19 can be a plastic ring, a plastic pad, a damping axle, or a damping spring, so that the first housing 16 and the second housing 24, when rotated relative to each other to reach a desired position, may stay at the desired position to allow a user to adjust and maintain the first housing 16 and the second housing 24 of the portable temperature regulation device at a desired state with easy operation and convenient use.

In the illustrated embodiment, the pivoting section 91 is formed with a through hole penetrating the top and bottom thereof. The through hole receives a rotation axle 122 to fit therein. The rotation axle 122 has a length greater than a height of the pivoting section 91. Two ends of the rotation axle 122 penetrate through the through hole to respectively project out of upper and lower ends of the pivoting section 91. Correspondingly, the second connecting end is provided with an axle hole 222 recessed in each of upper and lower end surfaces of the recessed notch 92 for pivotal connection with the two ends of the rotation axle 122. The damping piece 19 is selectively a rubber ring, which is fit to each of the two ends of the rotation axle 122. The rubber ring 19 has an outside diameter that is preferably greater than a diameter of the axle hole 222. When the pivoting section 91 and the recessed notch 92 are joined through insertion, the two ends of the rotation axle 122 are respectively inserted into the axle holes 222 formed on the two end surfaces of the recessed notch 92, with each rubber ring 19 correspondingly interposed between one end surface of the pivoting section 91 and a corresponding end surface of the recessed notch 92 to increase frictional damping between the pivoting section 91 and the recessed notch 92, allowing the first housing 16 and the second housing 24, after being rotated relative to each other about an axis defined by the rotation axle 122 to reach a desired location, to be positioned and retained in such the position.

It is appreciated that the rotation axle 122 and the pivoting section 91 can alternatively be formed integrally as one piece, such as the rotation axle 122 being formed by raising ends of the pivoting section 91 to similarly be connected, in a rotatable manner through insertion, to the axle holes 222 formed in the ends of the recessed notch 92.

As shown in FIG. 21, the first housing 16 is provided, in an interior thereof, with a first air guiding member 36 that extends in a lengthwise direction (including paralleling the lengthwise direction and forming an acute angle with the lengthwise direction). The first air guiding member 36 divides an interior space of the first housing 16 into a first air passage 34 and a first accommodation compartment 38. The first air passage 34 and the first accommodation compartment 38 are generally in the form of a triangle. The first air passage 34 is in communication with a first fan 18. The first air guiding member 36 is arranged inclining relative to the lengthwise direction of the first housing 16 so that the cross-section of the first air passage 34 is gradually reducing from a proximal end (namely the end that is adjacent to the first fan 18) toward a distal end (namely the end that is distant from the first fan 18), achieving a throttling effect for airflow and effectively increasing the flowing speed of the airflow at a location distant from the first fan 18, making airflow discharging through all first air outlets 22 more uniform. The first accommodation compartment 38 receives electronic components to dispose therein, such as a circuit board 30 and a battery. The first fan 18 is in electrical connection with the circuit board 30. The first housing 16 is provided with an ON/OFF switch 32 on an outer wall thereof at a location corresponding to the first accommodation compartment 38. The ON/OFF switch 32 is in electrical connection with the circuit board 30 and forms a control loop with the first fan 18, so that the user may control activation and deactivation of the first fan 18 by pressing down the ON/OFF switch 32. With the first air guiding member 36 dividing the interior of the first housing 16 to form the first accommodation compartment 38 separated from the first air passage 34, the electronic components can be installed independently, preventing influence of the airflow of the first fan 18 and also ensure the stability and security of the electrical connection of the first fan 18.

The first air passage 34 is provided, in an interior thereof, with a first air distributing plate 43 and a second air distributing plate 162, wherein the first air distributing plate 43 is located upstream of the second air distributing plate 162 and is closer to the first fan 18.

The first air distributing plate 43 comprises a first end and a second end that are opposite to each other. The first end and the second end are respectively oriented toward two opposite side walls of the first air passage 34. Similarly, the second air distributing plate 162 comprises a first end and a second end that are opposite to each other. The first end and the second end are respectively oriented toward two opposite side walls of the first air passage 34. In the instant embodiment, an upper wall of the first housing 16 serves as a first sidewall of the first air passage 34, and faces the first end of the first air distributing plate 43 and the first end of the second air distributing plate 162; the first air guiding member 36 serves as a second sidewall of the first air passage 34, and faces the second end of the first air distributing plate 43 and the second end of the second air distributing plate 162. The second end of the first air distributing plate 43 and the first air guiding member 36 are spaced from each other to define a first air outlet section 164 therebetween; the first end of the second air distributing plate 162 and the upper wall of the first housing 16 are spaced from each other to define a second air outlet section 166. Two ends of the first air outlet 22 are respectively extended outside the first air distributing plate 43 and the second air distributing plate 162, meaning an end of the first air outlet 22 is extended to a location of the first housing 16 that is between the first end of the first air distributing plate 43 and the first fan 18, namely at least a part of the first air outlet 22 is located at one side of the first air distributing plate 43 that faces toward the first fan 18, and an opposite end is extended to a location of the first housing 16 that is between the first end of the second air distributing plate 162 and the second housing 24. It is appreciated that in case that the first housing 16 does not include the first air guiding member 36, the upper and lower walls thereof respectively serve as the first and second sidewalls of the two opposite sides of the first air passage 34.

Preferably, the first air distributing plate 43 is inclined by an angle relative to an air flowing direction, so as to have the second end thereof closer to the first fan 18 than the first end. A spacing distance between the first air distributing plate 43 and the first fan 18 is gradually reduced from the first end toward the second end to provide an effect of guiding the airflow for causing a part of the airflow to flow out through the first air outlet 22 between the first air distributing plate 43 and the first fan 18, while a major portion of the airflow flows out of the first air outlet section 164 to subsequently move along the first air passage 34 toward a distant end thereof, thereby balancing the amount of air discharging through the first air outlet 22 at a proximal end of the first air passage 34, making the air discharging amount uniform through all parts of the first air outlets 22. In addition, the arrangement of the first air distributing plate 43 also changes the direction of the airflow for flowing out of the first air outlet 22 between the first air distributing plate 43 and the first fan 18, so that airflow, flowing out of that part of the first air outlet 22, may blow upward to the face of the human body, rather than blowing obliquely toward the rear neck. Preferably, the angle formed between the first air distributing plate 43 and the top section of the side wall of the first housing 16 is within 60 to 90 degrees. In the illustrated embodiment, the first end of the first air distributing plate 43 is integrally connected with the upper wall of the first housing 16, and the airflow from the first fan 18 may flow toward the distant end of the first air passage 34 only after passing through the first air outlet section 164. It is appreciated that the first end of the first air distributing plate 43 may alternately arranged to space from the upper wall of the first housing 16, so that a minor amount of the airflow of the first fan 18 can flow through a gap between the first end of the first air distributing plate 43 and the upper wall of the first housing 16 to subsequently flow toward the distant end of the first air passage 34. In other embodiments, the first air distributing plate 43 is arranged to incline at a predetermined angle relative to the air flowing direction, so as to have the second end thereof more distant from the first fan 18 than the first end.

Preferably, the second air distributing plate 162 exhibits, as a whole, a curved form, of which a side surface facing the first fan 18 is an arc surface for better guiding airflow and reducing kinetic energy loss for the airflow. The second end of the second air distributing plate 162 is closer to the first fan 18 than the first end, making the second air distributing plate 162 exhibiting an upward inclining configuration in a direction away from the first fan 18 for better guiding an airflow toward the first air outlet 22 in the upper wall of the first housing 16. In the illustrated embodiment, the second end of the second air distributing plate 162 is integrally connected with the first air guiding member 36, and the entire airflow flowing through the first air outlet section 164 into the space between the first air distributing plate 43 and the second air distributing plate 162 is acted upon by the second air distributing plate 162 to flow upward in an inclined manner, wherein a portion of the airflow passes through the second air distributing plate 162 to subsequently flow towards the distant end of the first air passage 34, allowing a part of the airflow to flow out through the first air outlet 22 between the second air distributing plate 162 and the first air distributing plate 43, while a remaining portion of the airflow flows out through the first air outlet 22 between the second air distributing plate 162 and the second housing 24 thereby homogenizing the discharging amount of air at various locations of the first air outlet 22 relative to the first air passage 34 and also guiding the airflow to flow out through the first air outlet 22 between the first air distributing plate 43 and the second air distributing plate 162 of which a flowing direction is generally parallel to the height direction of the first housing 16, making air flow toward the face of the human body rather than blowing inclinedly to the rear neck. It is appreciated that the second end of the second air distributing plate 162 and the first air guiding member 36 can alternatively be arranged to space from each other, so that a minor portion of the airflow may flow through the gap between the second end of the second air distributing plate 162 and the first air guiding member 36 to subsequently flow toward the distant end of the first air passage 34.

Preferably, the first air passage 34 is further provided with a third air distributing plate 168 arranged between the first air distributing plate 43 and the second air distributing plate 162. The third air distributing plate 168 has a length that is smaller than a length of the second air distributing plate 162, so that an airflow may flow over the third air distributing plate 168 to reach the second air distributing plate 162. An end of the third air distributing plate 168 is integrally connected with the first air guiding member 36, and an opposite end is set distant from the upper wall of the first housing 16. Preferably, an inclined angle between the third air distributing plate 168 and the first air guiding member 36 is greater than an inclined angle between the second air distributing plate 162 and the first air guiding member 36, meaning the third air distributing plate 168 is inclining upward at an angle that is greater than that of the second air distributing plate 162. The airflow that flows through the first air outlet section 164 is initially acted upon by the third air distributing plate 168 to guide upward by a great extent, and afterwards, with the flowing of the airflow, the airflow is spread between the first air distributing plate 43 and the second air distributing plate 162 and is then acted upon by the second air distributing plate 162 to be guided upward again to thereby ensure uniformity of the air discharging amount over all parts of the first air outlet 22.

Referring to FIGS. 22-29, a portable temperature regulation device 10 according to a seventh embodiment of the disclosure is provided. In the instant embodiment, the portable temperature regulation device 10 is wearable on the neck of a human body for regulating the temperature of the neck of the human body and comprises a wearing body and air-blowing devices rotatably connected to two ends of the wearing body. The first and second main bodies 14 each comprise a first housing 16, and the wearing body comprises a second housing 24. The second housing 24 and the first housing 16 are rotatably connected to each other by means of a rotating structure, so as to allow the first housing 16 to rotate leftwards and rightwards with respect to the second housing 24, allowing a user to easily adjust a spacing distance between the second housing 24 and the first housing 16 during wearing. The second housing 24 exhibits a curved form, surrounding and defining a storage space 25 for receiving the first housings 16. The two first housings 16 are each rotatable toward the storage space 25, so that the two first housings 16 each have at least a part receivable in the storage space 25, or the two first housings 16 are at least partly stackable on each other and at least a part of at least one first housing 16 is receivable in the storage space 25.

In the illustrated embodiment, each first housing 16 is provided with a first fan 18 arranged in an interior thereof. The second housing 24 is provided, in an interior thereof, with two second fans 26. Since the two first housings 16, as well as an internal structure thereof, are identical, only one of the first housings 16 and the internal structure thereof will be taken as an example for illustration in the following description.

Figure 24:
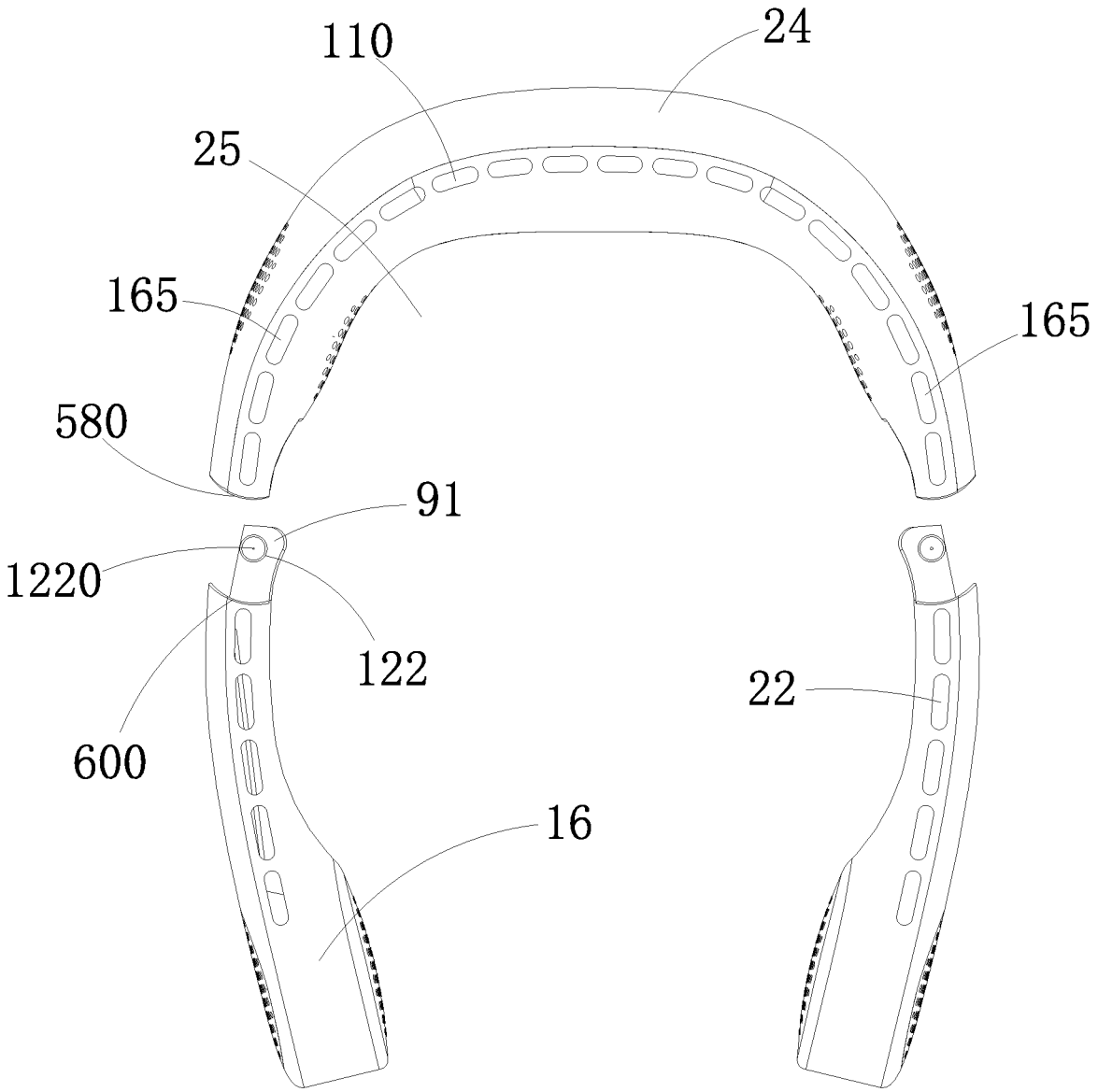
FIG. 24 is a schematic view illustrating first and second main bodies and a wearing body of the portable temperature regulation device of FIG. 22 in a separated state.
Figure 25:
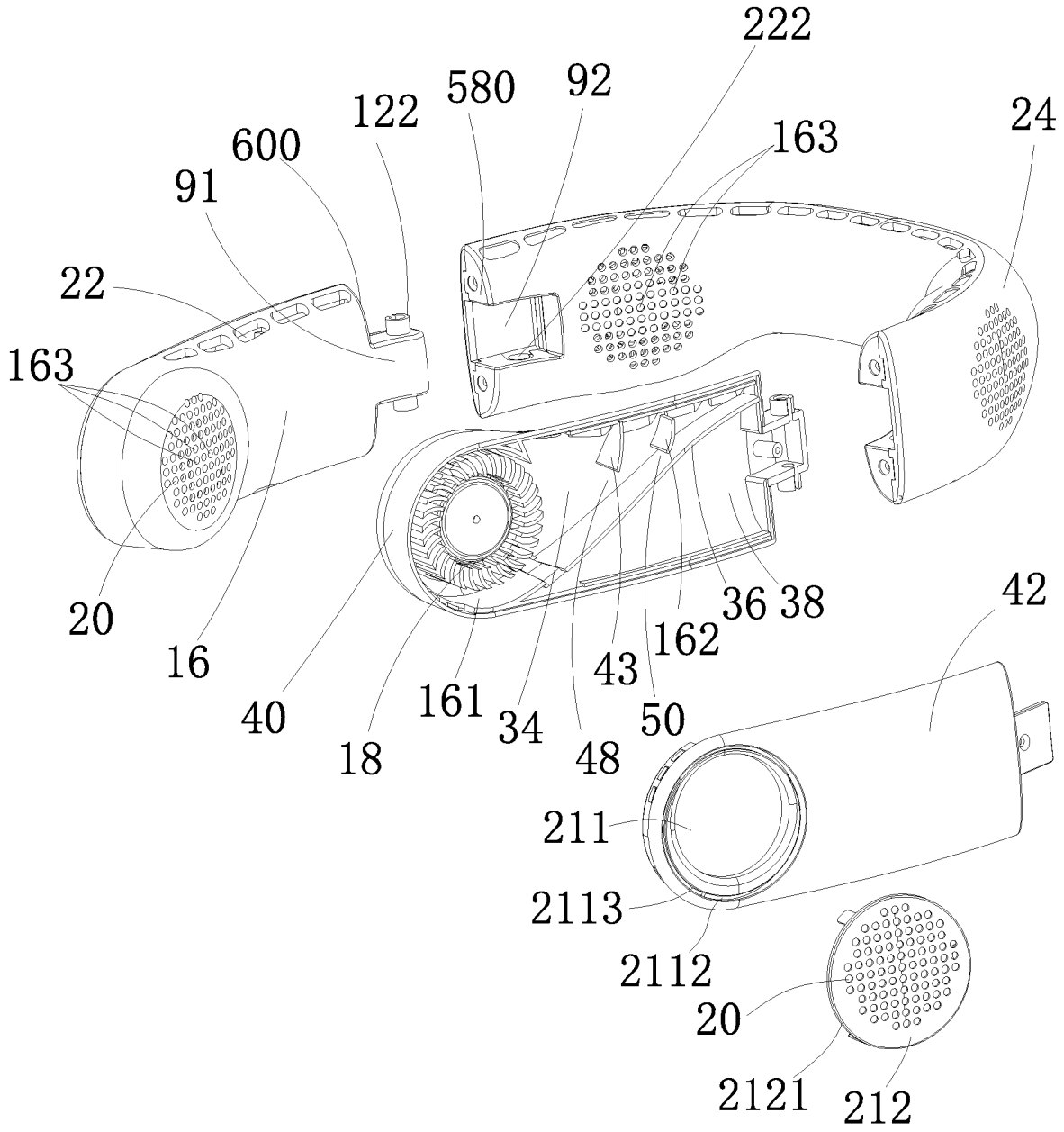
FIG. 25 is an exploded view of the portable temperature regulation device depicted in FIG. 22.

A first receiving chamber 161 is formed at an end of the interior of the first housing 16, and the first fan 18 is disposed in the first receiving chamber 161. Specifically, the first receiving chamber 161 is arranged at the end of the interior of the first housing 16 that is distant from the second housing 24. The first housing 16 is provided, in the interior thereof, with a first air passage 34 that extends in a lengthwise direction of the first housing 16 and is set in communication with the first receiving chamber 161. First air outlets 22 are formed in the top or bottom sections of the side wall of the first housing 16, and first air inlets 20 are formed in inner and/or outer walls of the first housing 16 to allow air to be drawn in by the first fan 18. The operation of the first fan 18 generates an airflow that moves through the first air passage 34 to blow outward through the first air outlet 22. In the present embodiment, the thickness of one end of the first housing 16 in which the first receiving chamber 161 is provided is greater than the thickness of the remaining parts of the first housing 16 (as shown in FIG. 24). Specifically, the inner surface of the end of the first housing 16, where the first receiving chamber 161 is provided, is convex relative to the inner surface of the remaining parts of the first housing 16, so that the first receiving chamber 161 with an enlarged size can accommodate the first fan 18, and the remaining parts with a reduced size make the volume of the first air passage 34 in the first housing 16 be small, which makes the airflow converge toward the air outlet 22 to provide an increased wind power of the discharged airflow.

Specifically, the first housing 16 comprises a first casing 40 and a second casing 42 that are connected to each other, and measures, such as snapping fastening and screw fastening, may be used to connect the second casing 42 and the first casing 40 in a detachable manner to allow for dismounting by a user. A first air guiding member 36 is arranged in the interior of the first housing 16, and a major surface of the first air guiding member 36 extends in a lengthwise direction and a thickness direction of the first housing 16. The first air guiding member 36 divides the internal cavity of the first housing 16 into a convergent first air passage 34 and a first accommodation compartment 38. The first air passage 34 is located on an upper side of the first air guiding member 36, and the first accommodation compartment 38 is located on a lower side of the first air guiding member 36. The first air outlets 22 corresponding to the first air passage 34 are formed in an inner side of a top section of the side wall of the first housing 16. The arrangement of the first air guiding member 36 helps reduce the size of the air passage, making air converging toward the air outlet 22 to provide an increased wind power of the discharged air.

The first air guiding member 36 is formed with a wire extension notch 149 that is in communication with and connects the first air passage 34 and the first accommodation compartment 38. A conductor wire connecting the first fan 18 and a circuit board 30 may extend through the wire extension notch 149. To fix the conductor wire, the wire extension notch 149 is provided, in an interior thereof, with a pressing plate 151 to fix the conductor wire in the wire extension notch 149 to eliminate randomness. Reinforcing ribs 153 may also be provided at the connection between the first air guiding member 36 and the first casing 40 to improve structural strength of the first air guiding member.

Further, the first air passage 34 is provided, in the interior thereof, with a first air distributing plate 43 and a second air distributing plate 162. A first sidewall and a second sidewall are respectively provided at two opposite sides of the first air passage 34. The first air outlets 22 are formed in the first sidewall. The first air distributing plate 43 is located between the second air distributing plate 162 and the first fan 18. The first air distributing plate 43 comprises a first end oriented toward the first sidewall and a second end oriented toward the second sidewall. The second end of the first air distributing plate 43 defines, with respect to the second sidewall of the first air passage 34, which is the first air guiding member 36, a first air outlet section 48 therebetween. A spacing distance between the second end of the first air distributing plate 43 and the first fan 18 is smaller than a spacing distance between the first end and the first fan 18. The first air outlets 22 formed in the first sidewall are at least partly located on side of the first air distributing plate 43 that faces toward the first fan 18. The first end of the first air distributing plate 43 is connected to the first sidewall. The second air distributing plate 162 comprises a first end oriented toward the first sidewall and a second end oriented toward the second sidewall. Second air outlet sections 50 are respectively defined between two ends of the second air distributing plate 162 and the first sidewall and the second sidewall, which are an upper wall of the first housing 16 and the first air guiding member 36. A spacing distance between the second end of the second air distributing plate 162 and the first fan 18 is smaller than a spacing distance between the first end and the first fan 18.

Figure 26:
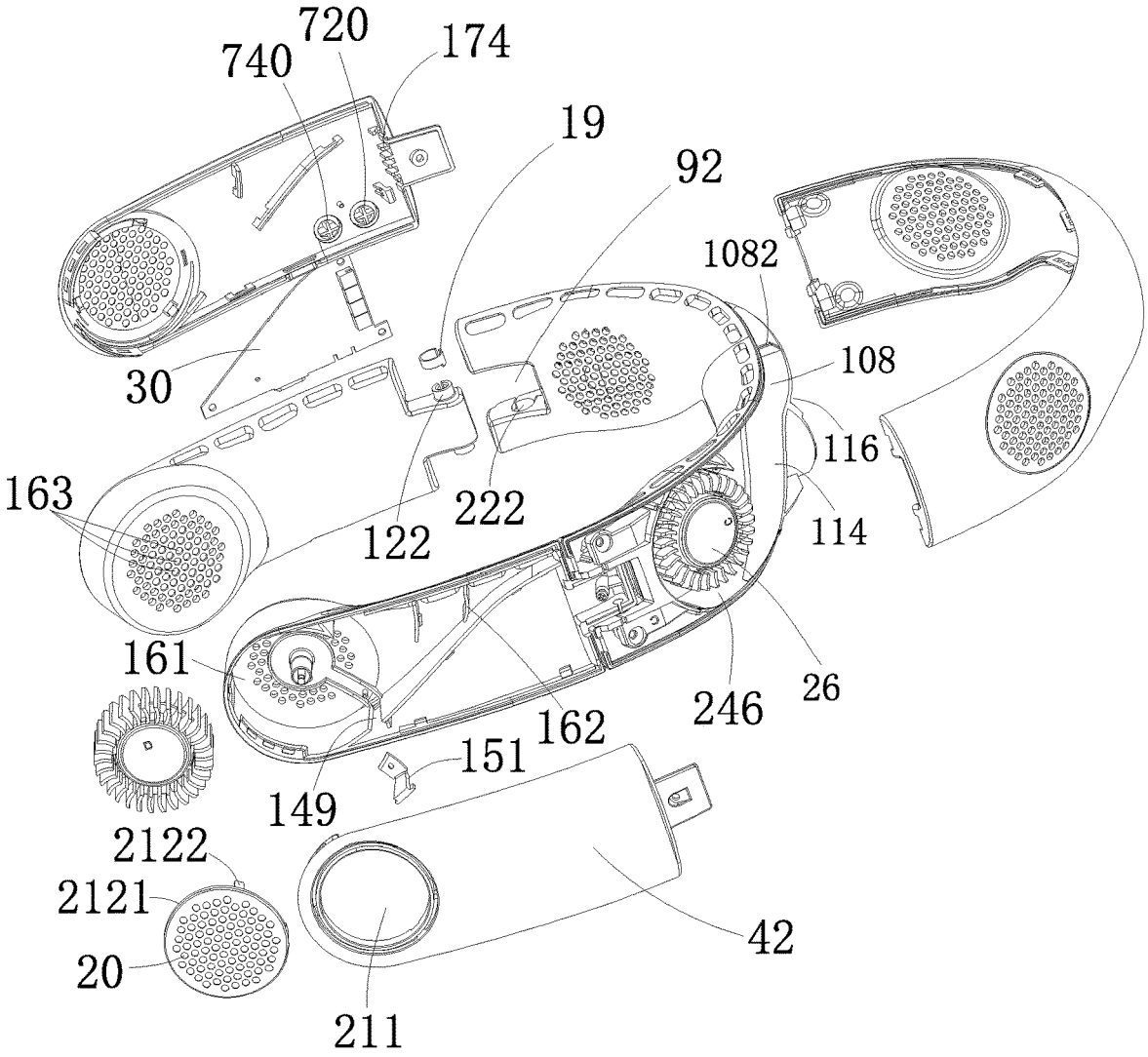
FIG. 26 is a further exploded view of the portable temperature regulation device depicted in FIG. 25.
Figure 27:
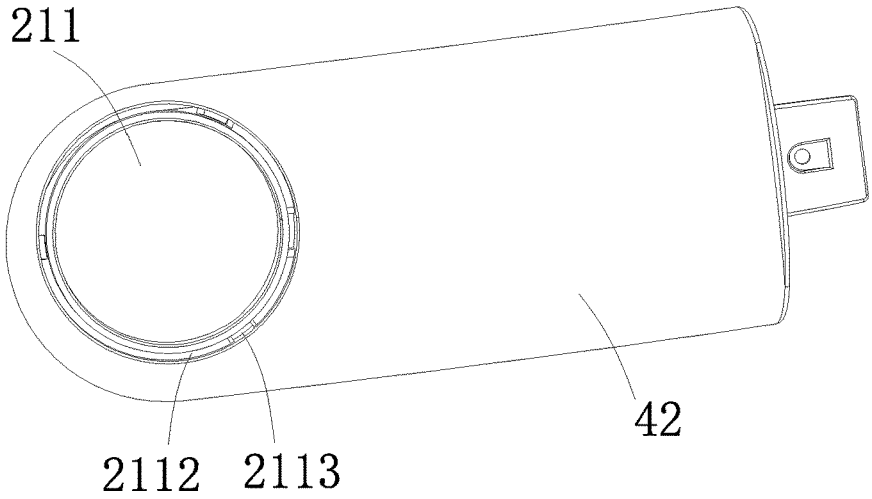
FIG. 27 is a schematic view showing a second casing of the portable temperature regulation device depicted in FIG. 26.
Figure 28:
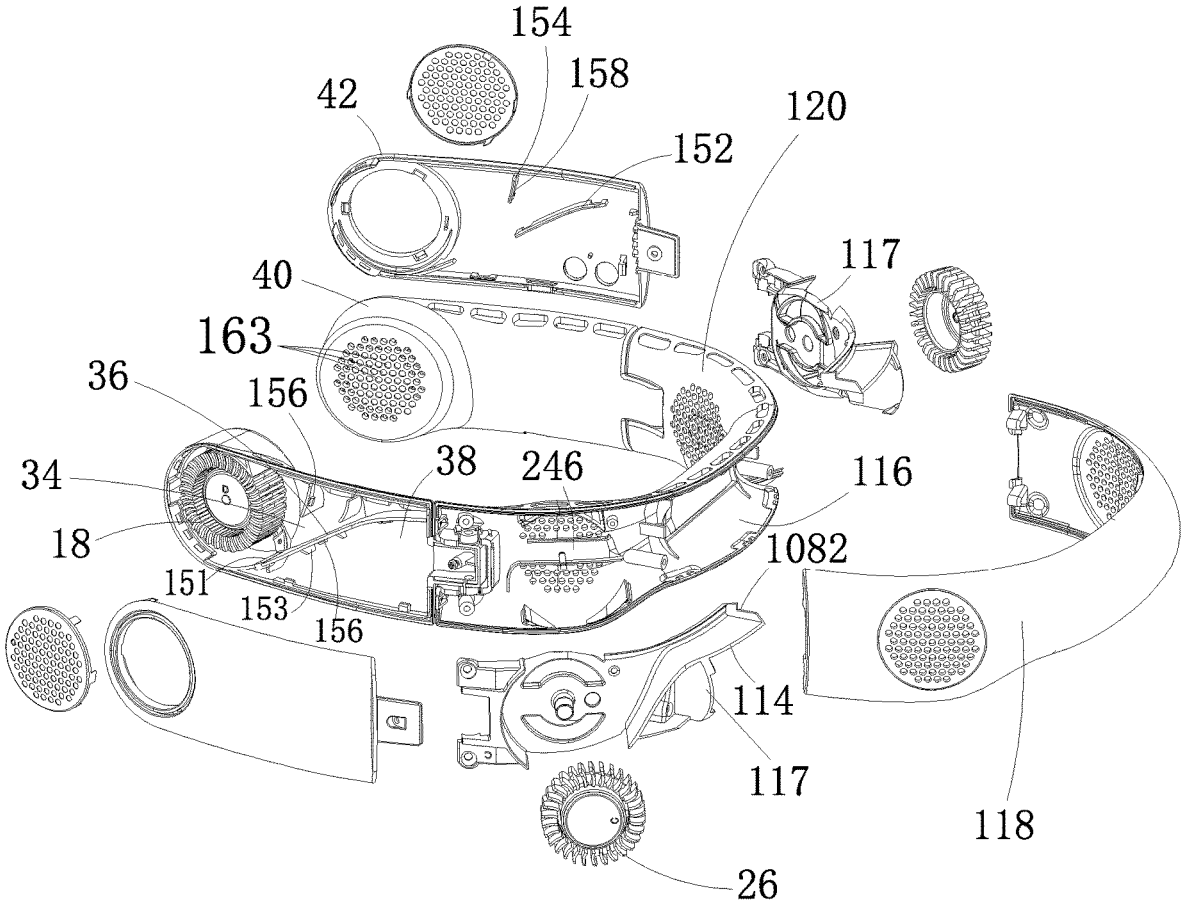
FIG. 28 is an exploded view of the portable temperature regulation device depicted in FIG. 26, taken from another angle.
Figure 29:
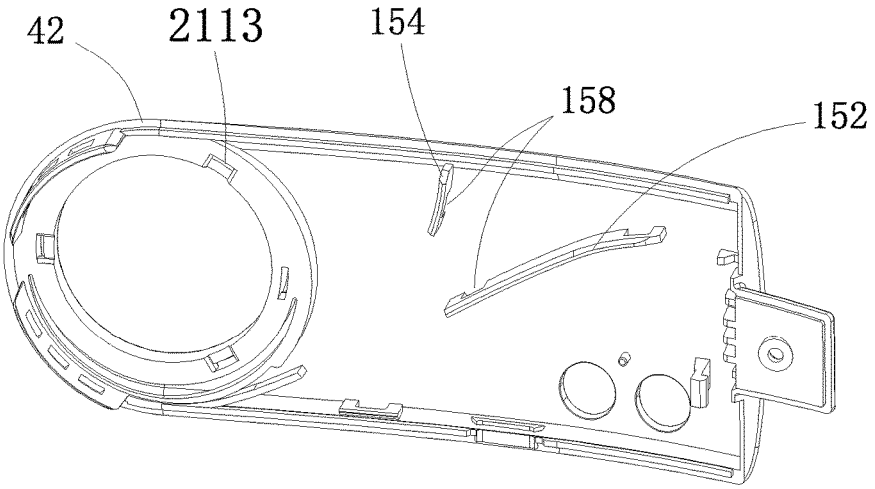
FIG. 29 is a schematic view showing a second casing of the portable temperature regulation device depicted in FIG. 28.

Referring to FIGS. 26 and 29, specifically, the first air guiding member 36 is provided on an inner surface of one of the first casing 40 and the second casing 42, and a fixing piece 152 is provided on an inner surface of the other one of the first casing 40 and the second casing 42. One of the first air guiding member 36 and the fixing piece 152 is formed with a retaining section 156, while the other one is formed with a retaining slot 158. The retaining section 156 and the retaining slot 158 mate each other through snap fitting so as to securely connect the first casing 40 and the second casing 42. Preferably, in the instant embodiment, the second casing 42 is provided, on the inner wall thereof, with the fixing piece 152 and a fixing plate 154. The fixing piece 152 and the fixing plate 154 are each formed with the retaining slot 158. The first casing 40 is provided, on the inner surface thereof facing the second casing 42, with the first air guiding member 36, the first air distributing plate 43, and the second air distributing plate 162. The first air guiding member 36 and the first air distributing plate 43 are each formed with the retaining section 156 for snapping fitting and coupling with the retaining slot 158.

Specifically, a top end of the first air distributing plate 43 (see FIG. 23) is connected to the top section of the side wall of the first housing 16, for example by means of integral connection. The first air distributing plate 43 is inclined by a predetermined angle relative to the air flowing direction, so that a bottom end thereof is set closer to the first fan 18. A spacing distance between the first air distributing plate 43 and the first fan 18 is gradually reduced from the top end toward the bottom end thereof, in order to achieve an effect of guiding the airflow, allowing a portion of the airflow to flow out through the first air outlet 22 between the first air distributing plate 43 and the first fan 18, while a major portion of the airflow flowing through the first air outlet section 48 flow subsequently along the first air passage 34 toward the distant end thereof, thereby balancing the air discharging amount of the first air outlets 22 at a location corresponding to the proximal end of the first air passage 34, and making the airflow consistent in various parts/locations of the first air outlets 22. Further, the arrangement of the first air distributing plate 43 helps change the direction in which the airflow flows out through the first air outlet 22 between the first air distributing plate 43 and the first fan 18, such that the airflow that flows out through such first air outlet 22 can blow upward, in a vertical direction, toward the face of the human body, rather than blowing inclinedly to the rear neck.

An inner end of the second air distributing plate 162 is connected to a top end portion of the inner wall of the first casing 40, for example by means of integral connection. The second air distributing plate 162, as a whole, exhibits a curved form, of which a side surface facing the first fan 18 is an arc surface for better guiding the airflow and reducing kinetic energy loss of the airflow. Since the first air guiding member 36 is arranged to incline upward in the air flowing direction, a bottom/second end of the second air distributing plate 162 is higher than the bottom/second end of the first air distributing plate 43. The bottom/second end of the second air distributing plate 162 is closer to the first fan 18 than the top/first end, so that the second air distributing plate 162 exhibits a downward inclined configuration in a direction toward the first fan 18 to provide an effect of guiding the airflow, allowing a portion of the airflow passing through the first air outlet section 48 to flow out through the first air outlet 22 between the second air distributing plate 162 and the first air distributing plate 43, while a major portion of the airflow passes through the second air outlet section 50 to subsequently flow along the first air passage 34 toward the distant end thereof, thereby balancing the air discharging amount of the first air outlet 22 at a location corresponding to a proximal end of the first air passage 34, making the airflow amount consistent in various parts of the first air outlets 22, and also guiding the airflow to flow out through the first air outlet 22 between the first air distributing plate 43 and the second air distributing plate 162 in a flowing direction that is generally parallel to the height direction of the first housing 16, making air flow toward the face of the human body rather than blowing inclinedly to the rear neck.

In other embodiments, at least a third air distributing plate can be further arranged between the first air distributing plate 43 and the second air distributing plate 162. The third air distributing plate can be connected to a sidewall of the first air passage 34, such as being connected to the first air guiding member 36.

In the illustrated embodiment, the first air outlet 22 comprises multiple air outlet holes arranged at intervals in the lengthwise direction of the first housing 16. The first air inlet 20 is of a mesh structure with a ventilated area and an unventilated area. The ventilated area comprises multiple through holes facing and communicating with the first receiving chamber 161. No air is permitted to pass through the unventilated area. Multiple blind holes 163 may be formed in the unventilated area. The first air inlet 20 being of a mesh structure is capable of effectively preventing the hair of the user from being drawn into the first fan 18. In the instant embodiment, an inner/first casing 40 and an outer/second casing 42 of the first housing 16 are provided, at locations corresponding to the first fan 18, with the first air inlets 20. Preferably, the shape and size of the cross section of the blind holes 163 are the same as that of the through holes. Further, the second casing 42 is provided with an opening 211 communicating with the first receiving chamber 161 at a position corresponding to the first receiving chamber 161. A protective cap 212 is installed at the opening 211. The protective cap 212 is provided with a flange 2121 at a periphery thereof, and the flange 2121 is formed by bending from the periphery of the protective cap 212 toward the opening 211. A groove 2112 is provided at the periphery of the opening 211. The flange 2121 is engaged in the groove 2112 to thereby attach the protective cap 212 at the opening 211 of the second casing 42. A clamping portion 2122 is formed on the flange 2121, a bayonet 2113 is formed at the bottom of the groove 2112, and the clamping portion 2122 is engaged into the bayonet 2113 to thereby firmly secure the protective cap 212 to the second casing 42. The outer air inlet 20 of the first housing 16 is defined in the protective cap 212 and communicates with the first receiving chamber 161 via the opening 211. The protective cap 212 is preferably made of a metal material with a high structural strength. The arrangement of the metal protective cap 212 can effectively increase the structural strength of the part of the side wall of the second casing 42 corresponding to the first receiving chamber 161. In some embodiments, the protective cap 212 has a double-layer structure with an inner layer and an outer layer, and each layer of the protective cap is provided with air inlet holes, and the two layers can be rotated relative to each other. By rotating the outer layer relative to the inner layer, the air inlet holes of the two layers can be misaligned or overlapped, so that the first air inlet 20 can be closed or opened. For example, when not in use, the outer air inlet 20 can be closed by rotating the outer layer of the protective cap 212 relative to the inner layer to prevent dust and other sundries from entering the first fan 18. In addition, the area of the outer air inlet 20 can be adjusted by rotating the outer layer of the protective cap relative to the inner layer, thereby adjusting the air inlet volume.

Specifically, two ends of the interior of the second housing 24 are respectively provided with second receiving chambers 246. Two second fans 26 are respectively disposed in the second receiving chambers 246. The second housing 24 is further provided, in the interior thereof, with two second air passages 108. The two second air passages 108 are respectively in communication with the second receiving chambers 246. The second air passages 108 are provided, in a sidewall thereof, with second air outlets 110, and the second receiving chambers 246 are provided, in a sidewall thereof, with second air inlets 112 to allow the second fans 26 to draw in air. The operation of the second fans 26 generates airflows that pass through the second air passages 108 to blow out through the second air outlets 110. Similarly, the second housing 24 is provided with a second air inlet area corresponding to the second receiving chamber 246, the second air inlet 112 includes a plurality of air inlet holes provided in the second air inlet area. The second air inlet area on the inner or outer surface of the second body 16 is also provided with a plurality of blind holes 163, the shape and size of the blind holes 163 are the same as the shape and size of the air inlet holes. The blind holes 163 are located in the middle part of the two air inlet areas and not communicated with the second receiving chamber 246. The air inlet holes are arranged around the blind holes 163, or the air inlet holes are arranged on both sides of the blind holes 163.

Figure 22:
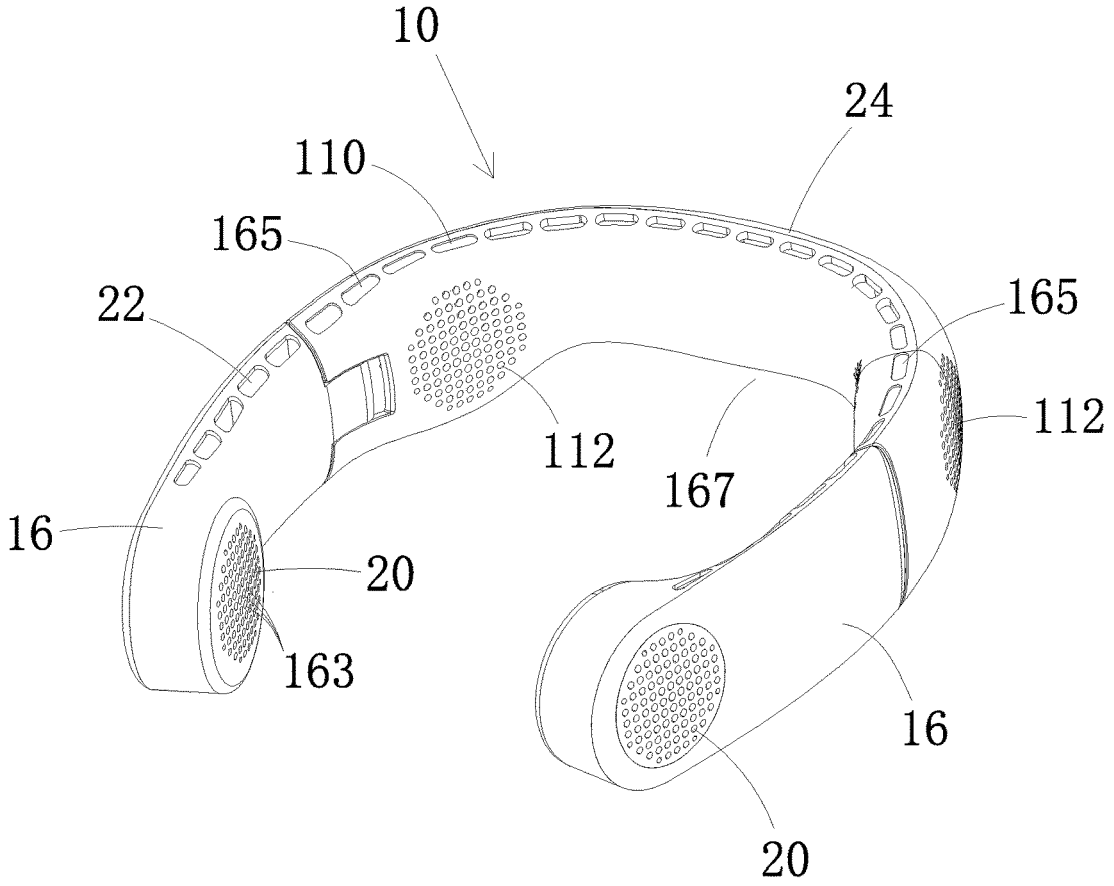
FIG. 22 is a perspective view showing a portable temperature regulation device according to a seventh embodiment of the present invention.

Each of opposite ends of the top surface of the second housing 24 defines one or more recesses 165 (see FIGS. 22-24). The second air outlet 22 is located between the recesses 165 defined at opposite ends of the second housing 24. The first air outlet 22, the recesses 165 and the second air outlet 22 are arranged along the top surface of the portable temperature regulation device in sequence.

The bottom surface of the second housing 24 is concaved with an avoidance slot 167. Thus, a wearing portion recessed relative to opposite ends of the wearing body is formed at the location of the wearing body corresponding to the avoidance slot 167. The wearing portion is configured to fit the neck of a human body, making the user more comfortable when wearing.

Specifically, the second housing 24 comprises an outer casing 118 and an inner casing 120. The outer casing 118 and the inner casing 120 are connected, in a detachable manner, by means of snapping fastening or screw fastening to allow for dismounting by the user. The second housing 24 is provided, in the interior thereof, with second air guiding members 114. Major surfaces of the second air guiding members 114 are arranged to extend along a lengthwise direction and a thickness direction of the second housing 24 to divide an interior cavity of the second housing 24 into a second accommodation compartment 116 and the second air passages 108 corresponding to the two second fans 26. Two ends of the second air guiding members 114 are respectively connected to bottom walls adjacent to the two second fan 26, so that the second accommodation compartment 116 is located in a lower portion of the interior of the second housing 24, and the second air passages 108 are located on an upper portion of the interior of the second housing 24. The second air outlets 110 are formed in an inner side of an upper wall of the second housing 24 to correspond to the second air passages 108.

Further, a separation member 1082 is arranged at a middle of an interior of the second air passage 108. The separation member 1082 divides the second air passage 108 into two isolated from each other and the two second air passages 108 respectively correspond to the two second fans 26. The operation of the two second fans 26 generates airflows that flow through the two second air passages 108 to blow out through corresponding ones of the second air outlets 110. Such an arrangement reduces the size of the air passage, making airflow concentrated to provide an increased wind power, and preventing airflows of the two second air passages 108 from interfering or impacting with each other to generate noise. Specifically, the second housing 24 exhibits a curved form for adapting to a human neck. The casing of the second housing 24 is provided with two mounting pieces 117 that are manufactured separate from the casing. The two mounting pieces 117 are mounted inside the casing of the second housing 24 and arranged in a lengthwise direction of the second housing 24. The mounting pieces 117 comprise amounting part arranged in the second receiving chamber 246 and a plate extending from the mounting part in the lengthwise direction of the second housing 24. The plate and an inner wall of the second housing 24 jointly enclose and define the second air passage 108. The second fan 26 is mounted on the mounting part. After the two mounting pieces 117 are mounted in the interior of the second housing 24, the plates of the two mounting pieces 117 are connected to each other to form the second air guiding members 114 and to jointly form, in combination with the sidewall of the second housing 24, the second air passage 108. In the instant embodiment, since the air passage structure and the fan mounting structure inside the second housing 24 are relatively complicated, the mounting pieces 117 are provided as separate parts for forming such structures, in order to facilitate the product fabrication and reduce product fabrication cost.

Since the rotating connection structures between the two first housings 16 and the second housing 24 are identical, only the rotating connection structure between one of the first housings 16 and the second housing 24 will be taken as an example for illustration.

The connecting ends of the second housing 24 and the first housing 16 that are rotatably connected have end faces that are formed with a convex curved surface 580 and a concave curved surface 600 (see FIG. 24) that mate with each other, such that the convex curved surface 580 is insertable into the concave curved surface 600 so that under the condition that the first housing 16 is rotatable, leftward and rightward, relative to the second housing 24, a gap between the end face of the first housing 16 and the end face of the second housing 24 is minimized, making the outside appearance of the product beautiful and effectively preventing invasion and jamming of foreign objects, such as clothing, in the gap between the two. Preferably, referring to FIGS. 22 and 24, with the second housing 24 and the first housing 16 being so rotatably connected, an outside surface of the second housing 24 smoothly transits to and connects with an outside surface of the first housing 16 to enhance product aesthetics. Preferably, a locking switch for locking/retaining the first and second housings 16, 24 at the folded state may be provided at the portable temperature regulation device. When the first housing 16 rotates to the stretched state relative to the second housing 24 (as shown in FIG. 22), the locking switch retains the first and second housings 16, 24 at the folded state. When the locking switch is pressed, the locking switch releases the first and second housings 16, 24 so that the first housing 16 can be rotated relative to the second housing 24 to the folded state. During the use of the device, the locking switch is capable of preventing the first housing 16 from rotating relative to the second housing 24 randomly to pinch the user's hair. Thus, the safety performance of the device is increased. Specifically, the locking switch may include a hook provided at one of the first housing 16 and the second housing 24, and a locking groove provided at the other of the first housing 16 and the second housing 24. The book has a pushing part exposed on the outer surface of the first or second housing. When the first housing 16 is rotated relative to the second housing 24 to the stretched state, the hook is engaged in the locking groove to thereby retain or lock the first and second housings 16, 24 in the stretched state. When the pushing part is pressed inwardly to make the hook disengage from the locking groove, the first housing 16 can be rotated inwardly relative to the second housing 24 to the folded state.

The rotating structure comprises a pivoting section 91 and a recessed notch 92. The pivoting section 91 is formed on one of the second housing 24 and the first housing 16, and the recessed notch 92 is formed in the other one of the second housing 24 and the first housing 16. The pivoting section 91 is received in the recessed notch 92 and the two are rotatably connected by means of a rotation axle 122. The rotation axle 122 extends in a height direction of the portable temperature regulation device so that the first housing 16 is rotatable leftward and rightward relative to the second housing 24 for folding or stretching. Preferably, the end of the pivoting section 91 that is connected to the first housing 16 is provided with multiple reinforcing ribs 174 to improve the structural strength of the pivoting section 91 for preventing the pivoting section 91 from breaking or rupturing during rotation.

In the illustrated embodiment, the pivoting section 91 protrudes from the concave curved surface 600 of the first housing 16 and is located on an inner side of an outer wall of the first housing 16. The recessed notch 92 is formed by recessing the convex curved surface 580 of the second housing 24 and is located on an inner side of an outer wall of the second housing 24 and penetrates through an inside surface of the second housing 24. Such a design effectively ensures integrity of the outer surfaces of the casings of the second housing 24 and the first housing 16, achieving better product aesthetics. When the first main body is rotated outward relative to the wearing body 24 to the stretched/unfolded state, the outer surfaces of the wearing body and the first main body connect smoothly. The rotation axle 122 has a central axis 1220, and in a plane perpendicular to the central axis, all parts of the concave curved surface 600 are spaced from the central axis 1220 by an equal distance and all parts of the convex curved surface 580 are spaced from the central axis 1220 by an equal distance, so that there is no interference between the concave curved surface 600 and the convex curved surface 580 when the first housing 16 is rotated leftward or rightward relative to the second housing 24. More specifically, upper and lower surfaces of the recessed notch 92 are respectively recessed to form axle holes 222 (which do not penetrate through the upper and lower surfaces of the second housing 24). The rotation axle 122 extends through or is integrally formed on upper and lower sides of the pivoting section 91. The two ends of the rotation axle 122 are respectively inserted into the two axle holes 222, so as to have the pivoting section 91 rotatably connected in the recessed notch 92.

Preferably, the rotation axle 122 can be made as a hollow structure, so that conductor wires that connect the electronic components (such as a battery and a circuit board) arranged inside the second housing 24 and the first housing 16 may run through the interior of the rotation axle 122 to prevent entangling of the conductor wires.

Preferably, a damping structure is arranged between the pivoting section 91 and the recessed notch 92, so that the first housing 16, after rotated relative to the second housing 24 to a desired position, may securely stay at such position. In the instant embodiment, the rotation axle 122 is sleeved with a damping ring 19 to increase a frictional force against rotation between the first housing 14 and the second housing 24, so that the first housing 16, after being rotated by a predetermined angle relative to the second housing 24, can be positioned.

The battery and the circuit board 30 may be disposed in the second accommodation compartment 116 of the second housing 24, or may alternatively be disposed in the first accommodation compartment 38 of the first housing 16, or alternatively, the battery and the circuit board 30 are respectively arranged in the second accommodation compartment 116 and the first accommodation compartment 38. Such an arrangement helps isolate the battery from the air passage, preventing airflow from being affected by heat generated by the battery. Specifically, in the instant embodiment, the circuit board 30 is arranged in the first accommodation compartment 38 of one of the first housings 16, while the battery is arranged in the second accommodation compartment 116 of the second housing 24, and the battery is electrically connected with the first fan 18 and the second fan 26.

In the illustrated embodiment, the portable temperature regulation device is further provided with a control switch electrically connected to the circuit board 30. The control switch functions to control the ON/OFF switch of the second fan 26 and the first fan 18 and regulation of air flowing speed. Preferably, the control switch is located at an end of the first housing 16 close to the second main body 24 and close to the bottom surface of the first main body 16, which facilitates operation of the user. Specifically, the control switch comprises a first pushbutton 720 and a second pushbutton 740 provided on an outer wall/casing of the first housing 16, wherein the second pushbutton 740 functions to control the airflow speeds of the second fan 26 and the first fan 18 and activation/deactivation of the portable temperature regulation device. For example, when the second pushbutton 740 is pressed down for the first time, the portable temperature regulation device is activated, and the second fan 26 and the first fan 18 are in operation at a first speed position, and re-pressing down the second pushbutton 740, the second fan 26 and the first fan 18 are set in operation at a second speed position that provide a stronger airflow, and further pressing down the second pushbutton 740 again, the second fan 26 and the first fan 18 are set in operation at a third speed position that further strengthen the airflow. Pressing down the second pushbutton 740 again would set the neck-banging temperature regulation device deactivated, namely the second fan 26 and the first fan 18 stop operation. The first pushbutton 720 functions to control activation/deactivation of the second fan 26. For example, after the portable temperature regulation device has been turned on, pressing the first pushbutton 720 may independently control activation/deactivation of the second fan 26, so as to allow the user to either only use the first fan 18 to generate airflow for cooling or simultaneously use the second fan 26 and the first fan 18 to generate airflow for cooling. Of course, the control switch may be alternatively set on the second housing 24, and the control function described above may be similarly achieved.

Figure 30:
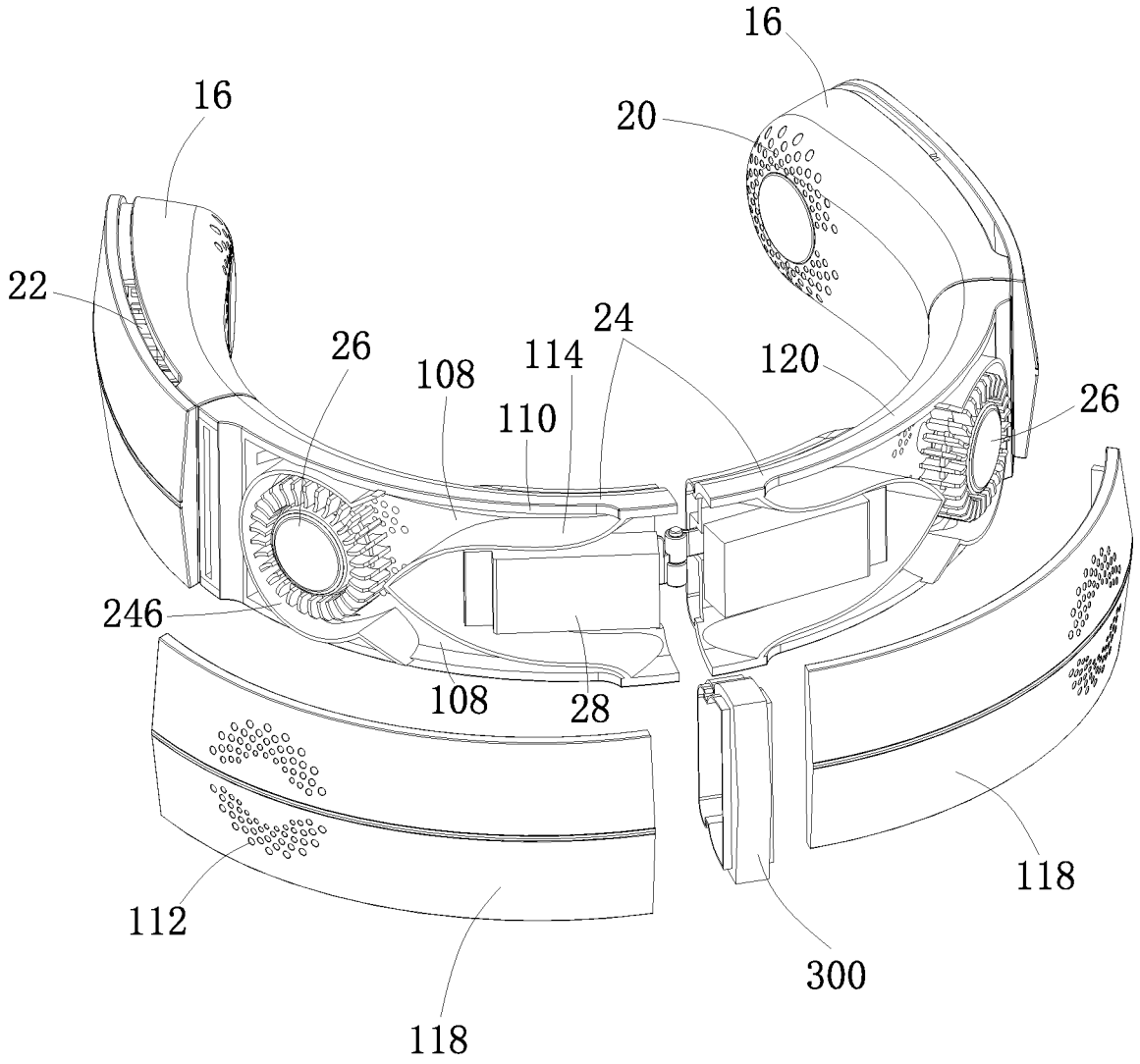
FIG. 30 is an exploded view showing a portable temperature regulation device according to an eighth embodiment of the present invention.
Figure 31:
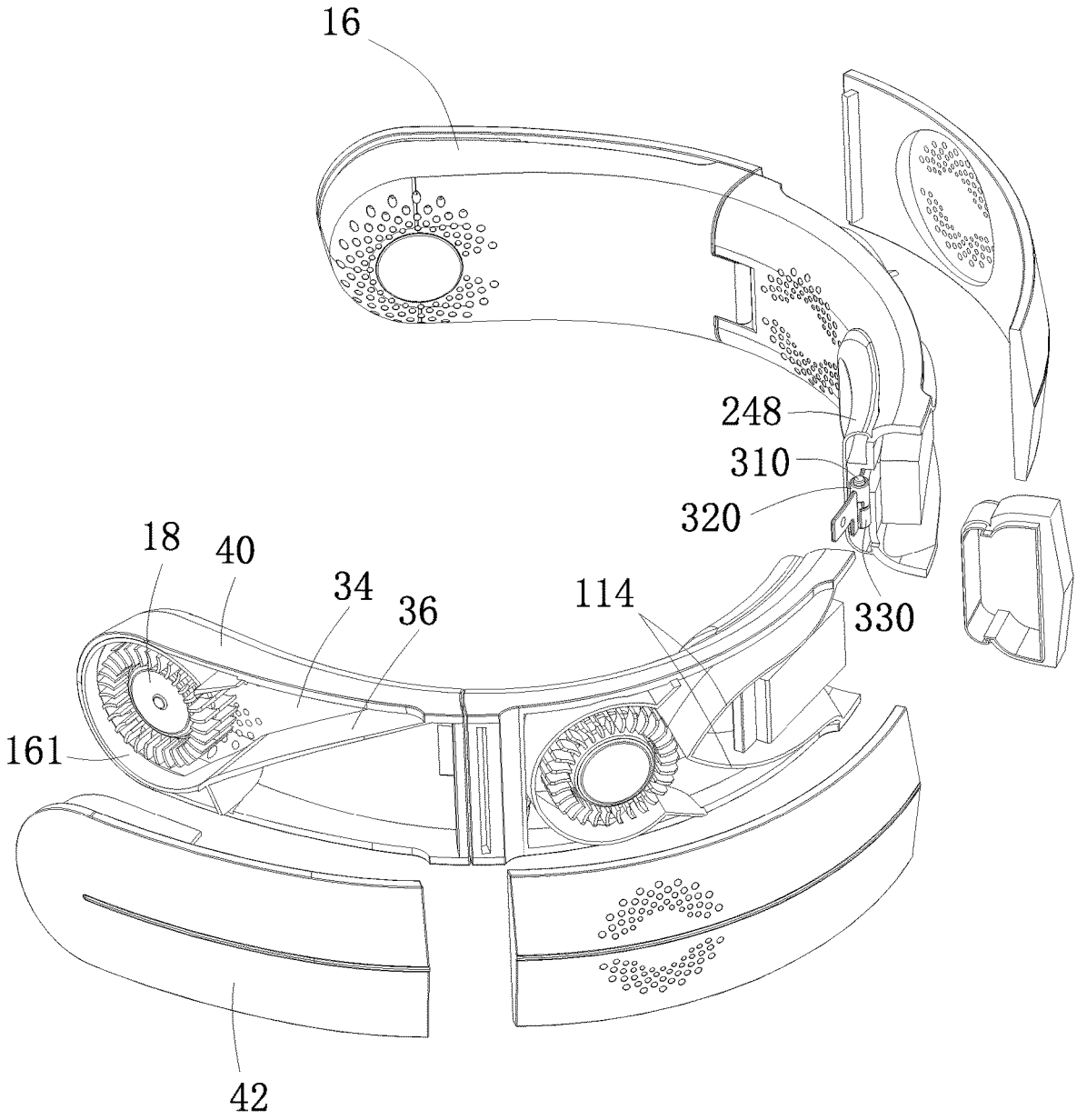
FIG. 31 is a further exploded view of the portable temperature regulation device depicted in FIG. 30.

Referring to FIGS. 30-31, which are schematic views showing a portable temperature regulation device according to an eighth embodiment of the present invention. In the instant embodiment, the wearing body is flexible or bendable or the wearing body comprises multiple parts being flexible or bendable relative to each other. Specifically, the second housing 24 of the portable temperature regulation device comprises two parts that are connected in a manner of being rotatable relative to each other. Each part is provided, in an interior thereof, with a second fan 26, a second air passage 108, and a battery 28. As such, the entire portable temperature regulation device may be further collapsed by subjecting the second housing 24 to such rotation, so as to further reduce the size of the entire portable regulation device for being easily carried by the user, or the two parts of the second housing 24 may be rotated in an outward direction to adjust an opening size between the two first housings 16, allowing the user to easily put the portable temperature regulation device on the neck of the user. Further, by providing a battery 28 in each of the two parts of the second housing 24, and available operation time of the portable temperature regulation device can be increased.

In the instant embodiment, the two parts of the second housing 24 are rotatably connected by means of a rotating structure. The rotating structure is similar to the rotating structure between the first housing 16 and the second housing 24 provided in the fifth embodiment discussed above and similarly comprises a rotation axle 310 and a first connecting member 320 and a second connecting member 330 that are fit over the rotation axle 310 and are respectively connected to the two segments of the second housing 24. The outside of the rotating structure is provided with and protected by a soft rubber enclosure 300. The soft rubber enclosure 300 is sleeved around the rotating structure with opposite ends of the soft rubber enclosure 300 being connected with the two parts of the second housing 24, thereby enclosing the rotating structure and connecting the two parts of the second housing 24 smoothingly to prevent hair of the user from being drawn into inside of the rotating structure and thus increase user safety. In other embodiments, the two parts of the second housing 24 are connected in a bendable manner by means of a bendable structure. The bendable structure can be a flexible metallic tube or a shaped metal wire. This similarly achieves reducing the size of the entire portable regulation device or bending the two segments outwards for adjusting the opening size between the two first housings 16. Preferably, a soft rubber enclosure is sleeved around the bendable structure.

Specifically, the second housing 24 is provided, in the interior thereof, with a second air guiding member 114. The second air guiding member 114 comprises two second plates, and the two second plates are connected to each other at ends thereof that are adjacent to the second fan 26. Ends of the two second plates that are distant from the second fan 26 are respectively connected to sidewalls of the second air passage 108 in order to divide the internal space of the second housing 24 into two second air passages 108. The second air outlet 110 comprises first and second air outlet holes/opening formed in sidewalls of the two second air passages 108 that are adjacent to the neck of a human body. The two second plates of the second air guiding members 114 define a mounting cavity therebetween and the battery 28 is mounted in the mounting cavity.

In the instant embodiment, a flexible member 248 is provided on an inner side of an inner casing 120 of the second housing 24 for contacting with the neck of a user. The flexible member 248 may be a cooling sheet with a cold-sensitive material, for example, a cooling soft gel made of a cold-sensitive material which can make the rear neck of the user feel cooler when the user wears the portable temperature regulation device. Alternatively, the flexible member may be an anti-slip sheet such as an anti-slip silica gel which can prevent the portable temperature regulation device from slipping off the user's neck when the user wears the portable temperature control device.

Figure 32:
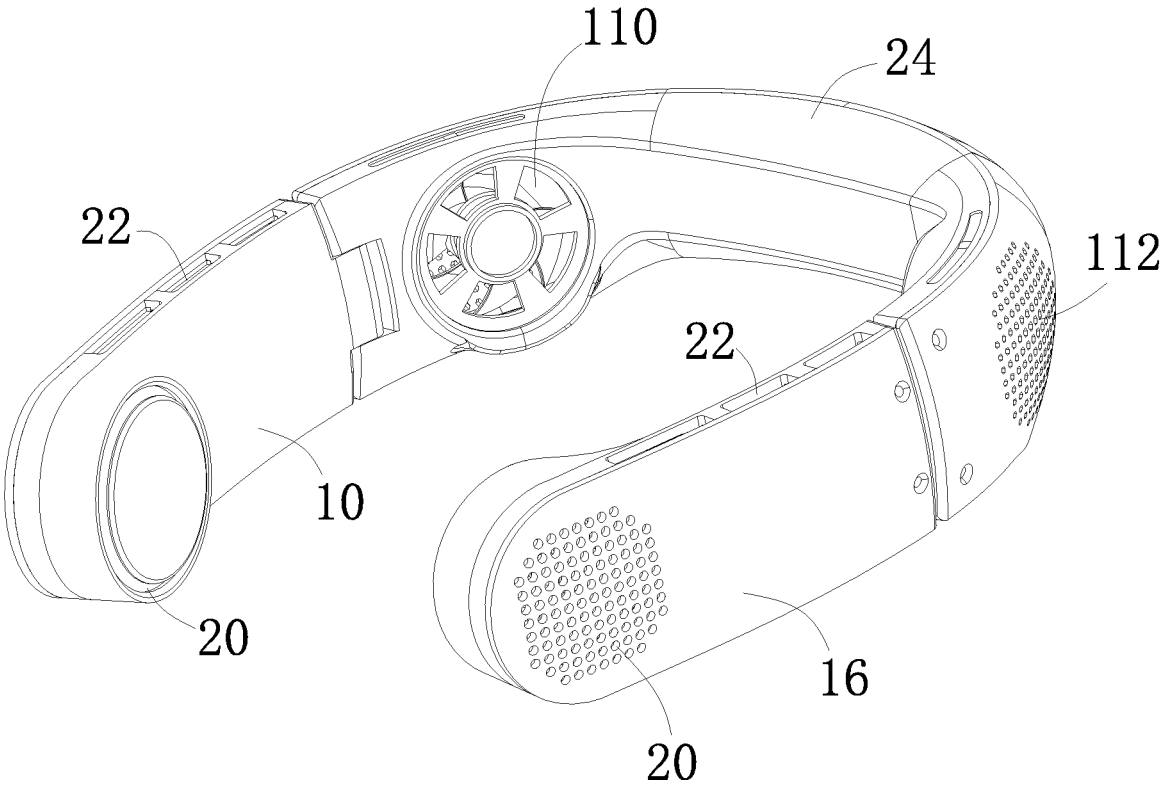
FIG. 32 illustrates a portable temperature regulation device according to a ninth embodiment of the present invention.
Figure 33:
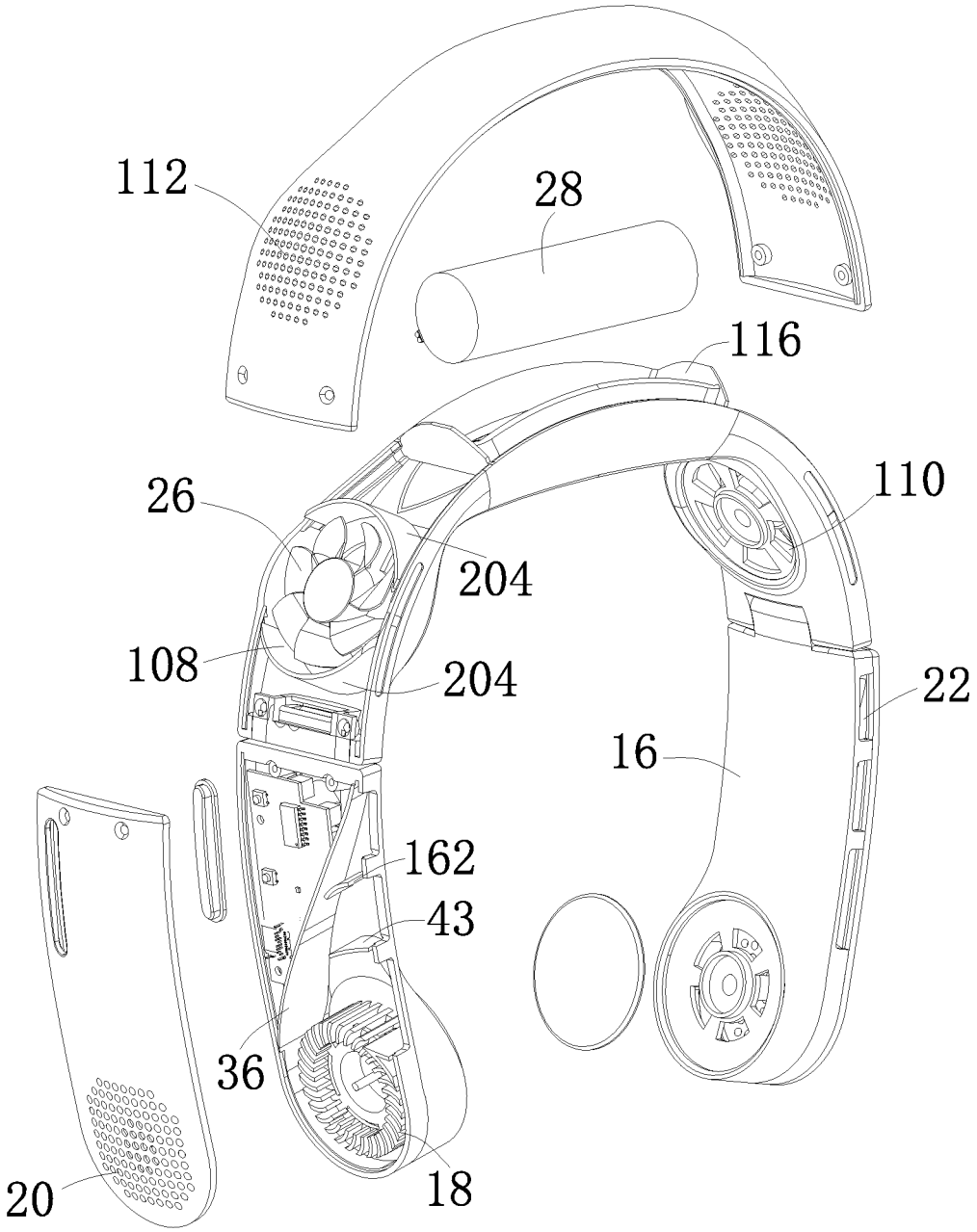
FIG. 33 is a partly exploded view of FIG. 32.

FIGS. 32-33 illustrate a portable temperature regulation device according to a ninth embodiment of the present invention. The structure of this embodiment is basically the same as that of the seventh embodiment, and the main difference resides in the second housing 24. In this embodiment, the second air outlets 110 are located in the inner surface of the second housing 24, and the second air inlets 112 are located in the outer surface of the second housing 24. The second fans 26 are axial fans. The second air inlets 112 and the second air outlets 110 are respectively located at opposite axial ends of the second fans 26. The airflow generated by the second fan 26 is blown out from the second air outlets 110 to blow to the rear neck of the human body. When the portable temperature regulating device of this embodiment is worn to the neck of the human body, the airflow blown out from the first air outlets 22 can be blown to the face of the human body to cool the faces of the human body, and the airflow blown out from the second air outlets 110 can be blown to the rear neck of the human body to cool the rear neck of the human body.

The second housing 24 is provided, in the interior thereof, with an arc-shaped shroud 204 around the second fan 26. The shroud 204 separates the second fan 26 from the other part of the internal space of the second housing 24, and opposite ends of the shroud 204 in the axial direction of the second fan 26 are respectively connected with the inner surface and the outer surface of the second main housing 24 to form a second air passage 108 which communicates with the second air inlet 112 and the second air outlet 110, so as to make the path for the airflow of the second fan 26 smoother and reduce turbulence. Therefore, the airflow generated by the second fan 26 can directly blow to the rear neck of the human body more intensively, and the heat dissipation effect is better.

Figure 34:
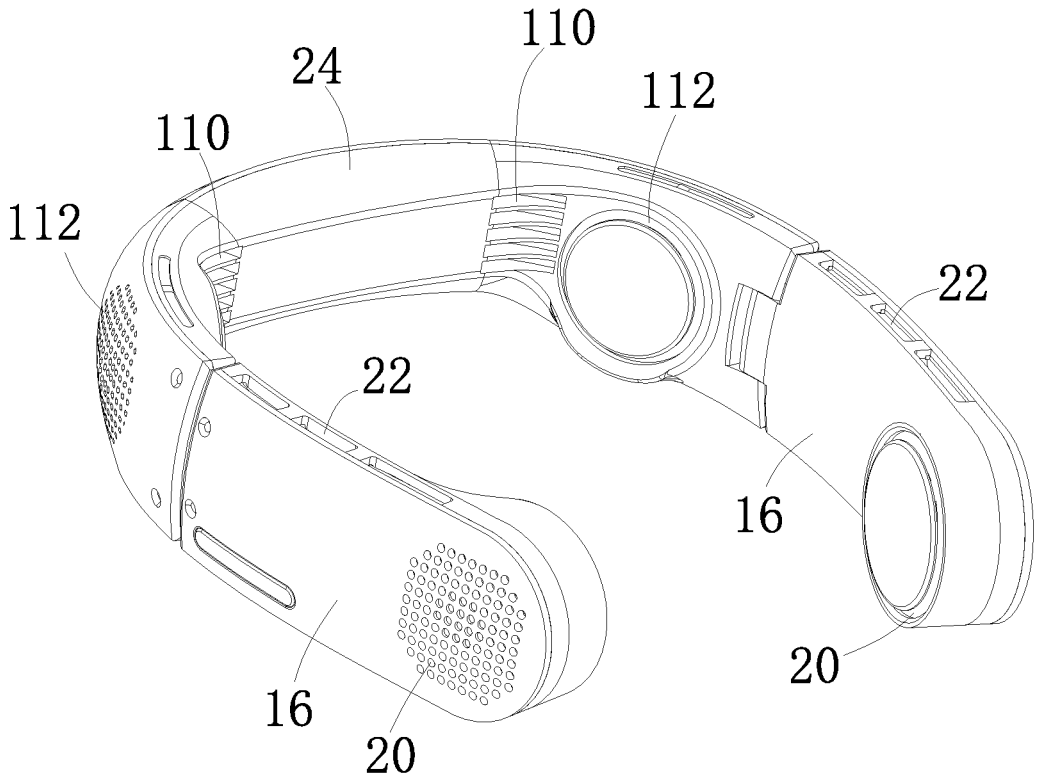
FIG. 34 illustrates a portable temperature regulation device according to a tenth embodiment of the present invention.
Figure 35:
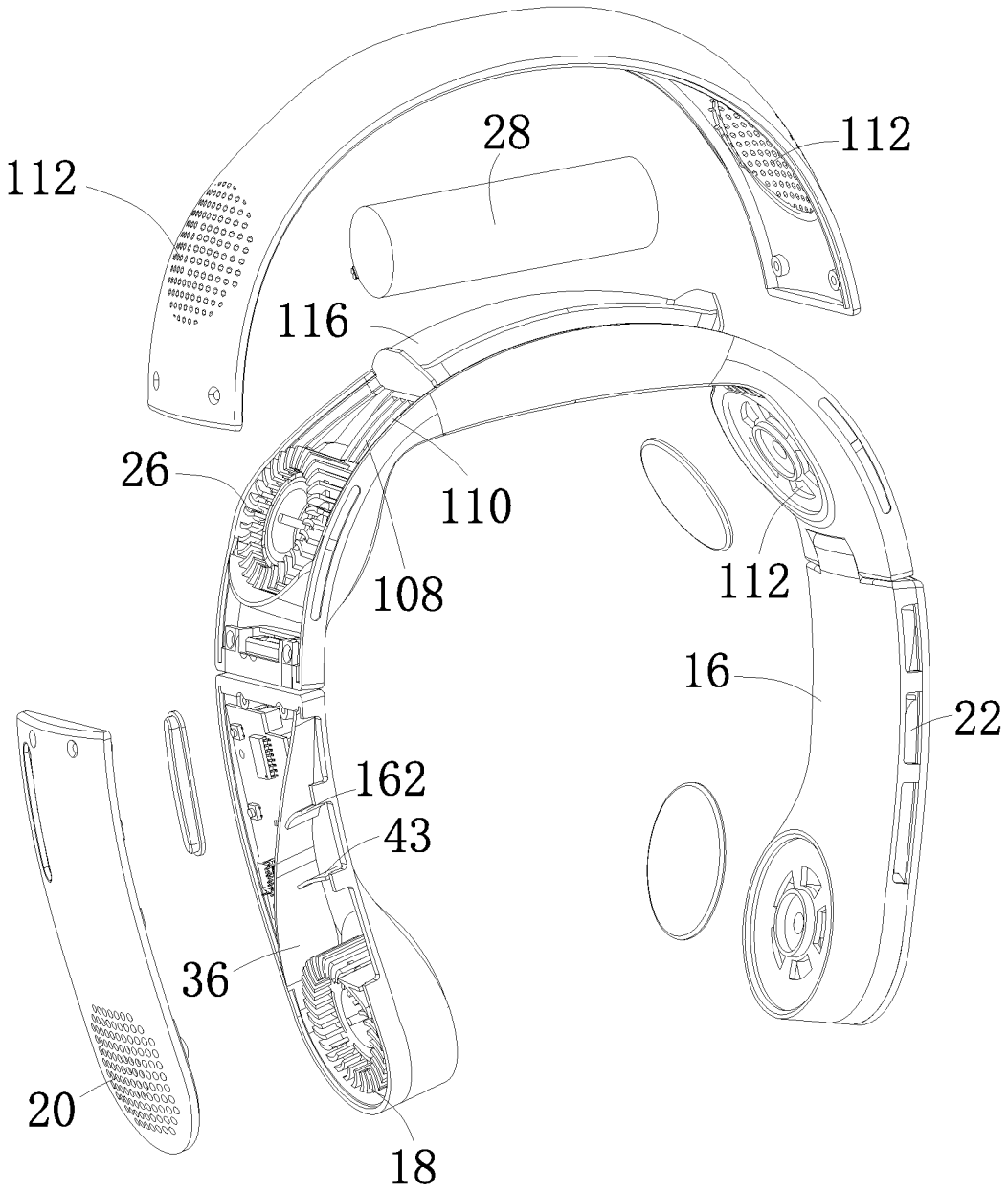
FIG. 35 is a partly exploded view of FIG. 30.

FIGS. 34-35 illustrate a portable temperature regulation device according to a tenth embodiment of the present invention. The structure of this embodiment is basically the same as that of the seventh embodiment, and the main difference resides in the second air outlet 110. In this embodiment, the second air outlet 110 is formed in the inner surface of the second housing 24 and in communication with the second air passage 108. The second air outlet 110 includes a plurality of elongated slots arranged at intervals in the height direction of the inner surface of the second housing 24. The airflow generated by the second fan 26 is blown out from the second air outlet 110 for blowing to the rear neck of the human body. When the portable temperature regulating device of the present embodiment is worn on the neck of the human body, the airflow blown out from the first air outlet 22 can be blown to faces of the human body to cool the faces of the human body, and the airflow blown out from the second air outlets 110 can be blown to the rear neck of the human body to cool the rear neck of the human body.

The concept provided in this disclosure can also be embodied in different forms that do not deviate from the sprit and characteristics thereof. The embodiments disclosed herein are provided as being illustrative, but not imitating. Thus, the scope of the protection that the application pursues is determined solely by the appended claims, and is not defined by the illustration provided above. Variations that are covered by the literal meaning, or equivalents thereof are considered falling within the scope defined by the claims.

What is claimed is:

1. A portable temperature regulation device comprising:

a wearing body; and a first main body and a second main body each having an air inlet portion and an air outlet portion;

wherein the first main body and the second main body are pivotably connected to opposite ends of the wearing body respectively so that the device has a stretched state and a folded state, in the folded state the wearing body, the first main body and the second main body being at least partly overlapped, in the stretched state the air outlet portion being located between the air inlet portion and the wearing body, wherein the air inlet portion comprises an inner surface defining an inner air inlet and an outer surface defining an outer air inlet.

2. The portable temperature regulation device according to claim 1, wherein the air outlet portion comprises an air outlet defined at a top surface and/or a bottom surface thereof, the air outlet being in communication with the inner and outer air inlets.

3. The portable temperature regulation device according to claim 1, wherein in the folded state, the first main body is overlapped with an inner surface of the wearing body and the second main body is located outside of the first main body and overlapped with the first main body.

4. The portable temperature regulation device according to claim 3, wherein the air inlet portion of the first main body contacts with the inner surface of the wearing body in the folded state; or an inner surface of the second main body contacts with an outer surface of the first main body in the folded state.

5. The portable temperature regulation device according to claim 1, wherein the wearing body comprises air inlet portions and an air outlet portion located between the air inlet portions; or the wearing body comprises air outlet portions and an air inlet portion located between the air outlet portions.

6. The portable temperature regulation device according to claim 5, wherein the air inlet portion of the wearing body comprises an inner surface defining an inner air inlet and an outer surface defining an outer air inlet.

7. The portable temperature regulation device according to claim 6, wherein the air outlet portion of the wearing body comprises an air outlet defined at a top surface and/or a bottom surface thereof, the air outlet communicating with the inner and outer air inlets.

8. The portable temperature regulation device according to claim 1, wherein the wearing body has a wearing portion formed between and recessed relative to opposite ends of the wearing body.

9. The portable temperature regulation device according to claim 1, wherein the air outlet portion comprises at least one elongated outlet hole with a length edge and a width edge shorter than the length edge, the length edge extending along a lengthwise direction of the device.

10. The portable temperature regulation device according to claim 1, wherein the air inlet portion comprises a mesh structure with a ventilated area and an unventilated area, the ventilated area defining a plurality of through holes.

11. The portable temperature regulation device according to claim 1, wherein the wearing body is flexible or bendable or the wearing body comprises multiple parts be flexible or bendable relative to each other.

12. The portable temperature regulation device according to claim 1, wherein the wearing body comprises two air inlet portions and an air outlet portion located between the air inlet portions, each of the air inlet portions provides a fan and an air inlet corresponding to the fan, the air outlet portion comprises two sections isolated from each other and each section comprises an air outlet in communication with a corresponding air inlet.

13. The portable temperature regulation device according to claim 1, wherein one of the first main body, the second main body and the wearing body comprises first and second outlet holes, an air guiding member is arranged in an internal space of said one of the first main body, the second main body and the wearing body to divide the internal space into two air passages respectively corresponding to the first and second outlet holes.

14. The portable temperature regulation device according to claim 1, wherein a semiconductor temperature regulation assembly is arranged in the wearing body and the semiconductor temperature regulation assembly comprises a contact surface exposed from an inner surface of the wearing body; or a flexible member is provided on an inner surface of the wearing body.

15. A portable temperature regulation device comprising:

a wearing body; and a first main body and a second main body each having an air inlet portion and an air outlet portion;

wherein the first main body and the second main body are pivotably connected to opposite ends of the wearing body respectively so that the device has a stretched state and a folded state, in the folded state the wearing body, the first main body and the second main body being at least partly overlapped, in the stretched state the air outlet portion being located between the air inlet portion and the wearing body;

wherein one of the first main body and the wearing body provides a recessed notch and the other provides a pivoting section pivotably received in the recessed notch; or connecting members are mounted to the first main body and the wearing body respectively and the connecting members are pivotably connected to each other.

16. The portable temperature regulation device according to claim 15, wherein one of the wearing body and the first main body defines a recessed notch at a connecting end thereof, the recessed notch passes through an inner surface and an end surface of the connecting end and is covered by an outer surface of the connecting end, and a pivoting section pivotably connecting the first main body and the wearing body is received in the recessed notch.

17. The portable temperature regulation device according to claim 15, wherein a convex surface and a concave surface are respectively formed at adjacent connecting ends of the first main body and the wearing body, the convex surface mating with the concave surface.

18. The portable temperature regulation device according to claim 15, wherein a semiconductor temperature regulation assembly is arranged in the wearing body and the semiconductor temperature regulation assembly comprises a contact surface exposed from an inner surface of the wearing body; or a flexible member is provided on an inner surface of the wearing body.

19. A portable temperature regulation device comprising:

a wearing body; and a first main body and a second main body each having an air inlet portion and an air outlet portion;

wherein the first main body and the second main body are pivotably connected to opposite ends of the wearing body respectively;

wherein the air inlet portion provides a fan;

the first main body comprises an inner wall, an outer wall and a side wall connected between the inner wall and the outer wall;

the side wall comprises a top section and a bottom section opposite to the top section; and an air guiding member extends from a portion of the bottom section close to the fan toward the wearing body or a portion of the top section close to the wearing body, so that an air passage communicating the air inlet with the air outlet is defined between the air guiding member and the top section of the side wall.

20. The portable temperature regulation device according to claim 19, wherein an air distributing member is arranged in the air passage to divide the air passage into multiple sub air passages, and the air outlet portion comprises an air outlet with multiple sections facing and communicating with the multiple sub air passages respectively, so that airflow generated by the fan exits the first main body via the multiple sections of the air outlet after passing through the multiple sub air passages.

* * * * *